US011499212B2

(12) United States Patent
Lu et al.

(10) Patent No.: US 11,499,212 B2
(45) Date of Patent: Nov. 15, 2022

(54) COMPLEX CONCENTRATED ALLOYS: MATERIALS, METHODS, AND TECHNIQUES FOR MANUFACTURE

(71) Applicant: QUESTEK INNOVATIONS LLC, Evanston, IL (US)

(72) Inventors: Pin Lu, Glenview, IL (US); James Saal, Honolulu, HI (US); Greg Olson, Riverwoods, IL (US)

(73) Assignee: QUESTEK INNOVATIONS LLC, Evanston, IL (US)

( * ) Notice: Subject to any disclaimer, the term of this patent is extended or adjusted under 35 U.S.C. 154(b) by 942 days.

(21) Appl. No.: 16/169,855

(22) Filed: Oct. 24, 2018

(65) Prior Publication Data

US 2019/0119796 A1 Apr. 25, 2019

Related U.S. Application Data

(60) Provisional application No. 62/576,904, filed on Oct. 25, 2017.

(51) Int. Cl.

| | |
|---|---|
| ***C22C 1/02*** | (2006.01) |
| ***C22C 30/00*** | (2006.01) |
| ***C22C 38/44*** | (2006.01) |
| ***C22C 5/04*** | (2006.01) |
| ***C22C 33/04*** | (2006.01) |

(52) U.S. Cl.

CPC ..... *C22C 38/44* (2013.01); *C22C 1/02* (2013.01); *C22C 5/04* (2013.01); *C22C 30/00* (2013.01); *C22C 33/04* (2013.01); *C22C 2200/00* (2013.01)

(58) Field of Classification Search

None

See application file for complete search history.

(56) References Cited

U.S. PATENT DOCUMENTS 10,472,702 B2 * 11/2019 Yeh ..... C22C 30/00
2018/0036840 A1 * 2/2018 Hu ..... B23K 15/0093

OTHER PUBLICATIONS

Swanson et al., "Localized Corrosion Behavior of a Ni-Based High-Entropy Alloy," <https://ecs.confex.com/ecs/232/webprogram/Paper104999.html> dated Oct. 4, 2017 (2 pages).

* cited by examiner

*Primary Examiner* — Keith D. Hendricks
*Assistant Examiner* — Joshua S Carpenter
(74) *Attorney, Agent, or Firm* — Michael Best & Friedrich LLP

(57) ABSTRACT

Complex concentrated alloys include five or more elements, at least one of which is ruthenium. Example complex concentrated alloys can include nickel and chromium, iron, ruthenium, molybdenum, and/or tungsten. Example complex concentrated alloys have single phase microstructure of face centered cubic (FCC) and can be homogenous. Example complex concentrated alloys can exhibit improved corrosion resistance.

18 Claims, 27 Drawing Sheets

COMPLEX CONCENTRATED ALLOYS: MATERIALS, METHODS, AND TECHNIQUES FOR MANUFACTURE

CROSS-REFERENCE

The present application claims priority to U.S. provisional patent application No. 62/576,904, filed on Oct. 25, 2017, the disclosure of which is hereby incorporated by reference in its entirety.

GOVERNMENT INTEREST

Aspects of the present disclosure were made with government support under contract number DE-SC0016584 awarded by the U.S. Department of Energy. The government has certain rights in the disclosure.

TECHNICAL FIELD

The present disclosure relates to materials, methods and techniques for manufacturing complex concentrated alloys. More particularly, complex concentrated alloys disclosed and contemplated herein include at least five elements, one of which being ruthenium (Ru).

INTRODUCTION

Complex concentrated alloys (CCAs) are materials with complex compositions and/or microstructures comprising more than one element that is concentrated in the material. CCAs are a broad group of materials that include the alloys in the so-called high entropy alloy (HEA) field. CCAs generally possess high configurational entropy and are able to achieve stabilized compositionally complex, disordered solid solution structures. CCAs are distinct from conventional alloys in various ways. For instance, CCAs are not based on a single, majority host element, such as iron (Fe) in steels, nickel (Ni) in superalloys, and aluminum (Al) in aluminum alloys. Rather, CCAs include multiple principle elements, which are a departure from conventional alloy design limitations and enables vast degrees of freedom in alloy compositions and properties.

In creating a solid solution from pure elements, the free energy of mixing can be expressed as:

$$\Delta G_{mix}=\Delta H_{mix}-T\Delta S_{mix} \quad (1)$$

where $\Delta H_{mix}$ is the enthalpy of mixing, T the temperature and $\Delta S_{mix}$ the entropy of mixing. For ideal mixing, the entropy of mixing equals the configuration entropy change per mole upon mixing that is calculated as follows:

$$\Delta S_{config}=-R\Sigma_i \ln x_i \quad (2)$$

where R is the ideal gas constant (8.314 Joule/mole K) and $x_i$ is the mole fraction of composing element i. Equations (1) and (2) show that $\Delta S_{config}$ increases (becomes more positive) as the number of elements increases. A more positive $\Delta S_{config}$ helps lower the Gibbs free energy of a solid solution system and thus stabilizes the alloy with the stabilizing effect being more pronounced when T is large, i.e., at high temperatures.

SUMMARY

Materials, methods and techniques disclosed and contemplated herein relate to complex concentrated alloys. Generally, complex concentrated alloys include five or more components and have high configurational entropy. Complex concentrated alloys disclosed and contemplated herein include nickel (Ni), chromium (Cr), iron (Fe), ruthenium (Ru), molybdenum (Mo), and/or tungsten (W).

In one aspect, a complex concentrated alloy is disclosed. The complex concentrated alloy includes, by atomic percentage, 16% to 29% chromium; 15% to 33% iron; 2% to 18% ruthenium; 4% to 8% molybdenum; 1% to 3.5% tungsten; and the balance of atomic percent comprising nickel and incidental elements and impurities.

In another aspect, a method for producing a complex concentrated alloy is disclosed. The method includes preparing a melt that includes, by atomic percentage, 16% to 29% chromium; 15% to 33% iron; 2% to 18% ruthenium; 4% to 8% molybdenum; 1% to 3.5% tungsten; and the balance of atomic percent comprising nickel and incidental elements and impurities.

In another aspect, a manufactured article is disclosed. The manufactured article comprises an alloy that includes, by atomic percentage, 16% to 29% chromium; 15% to 33% iron; 2% to 18% ruthenium; 4% to 8% molybdenum; 1% to 3.5% tungsten; and the balance of atomic percent comprising nickel and incidental elements and impurities.

There is no specific requirement that a material, technique or method relating to waste processing include all of the details characterized herein, in order to obtain some benefit according to the present disclosure. Thus, the specific examples characterized herein are meant to be exemplary applications of the techniques described, and alternatives are possible.

DETAILED DESCRIPTION

Figure 1:
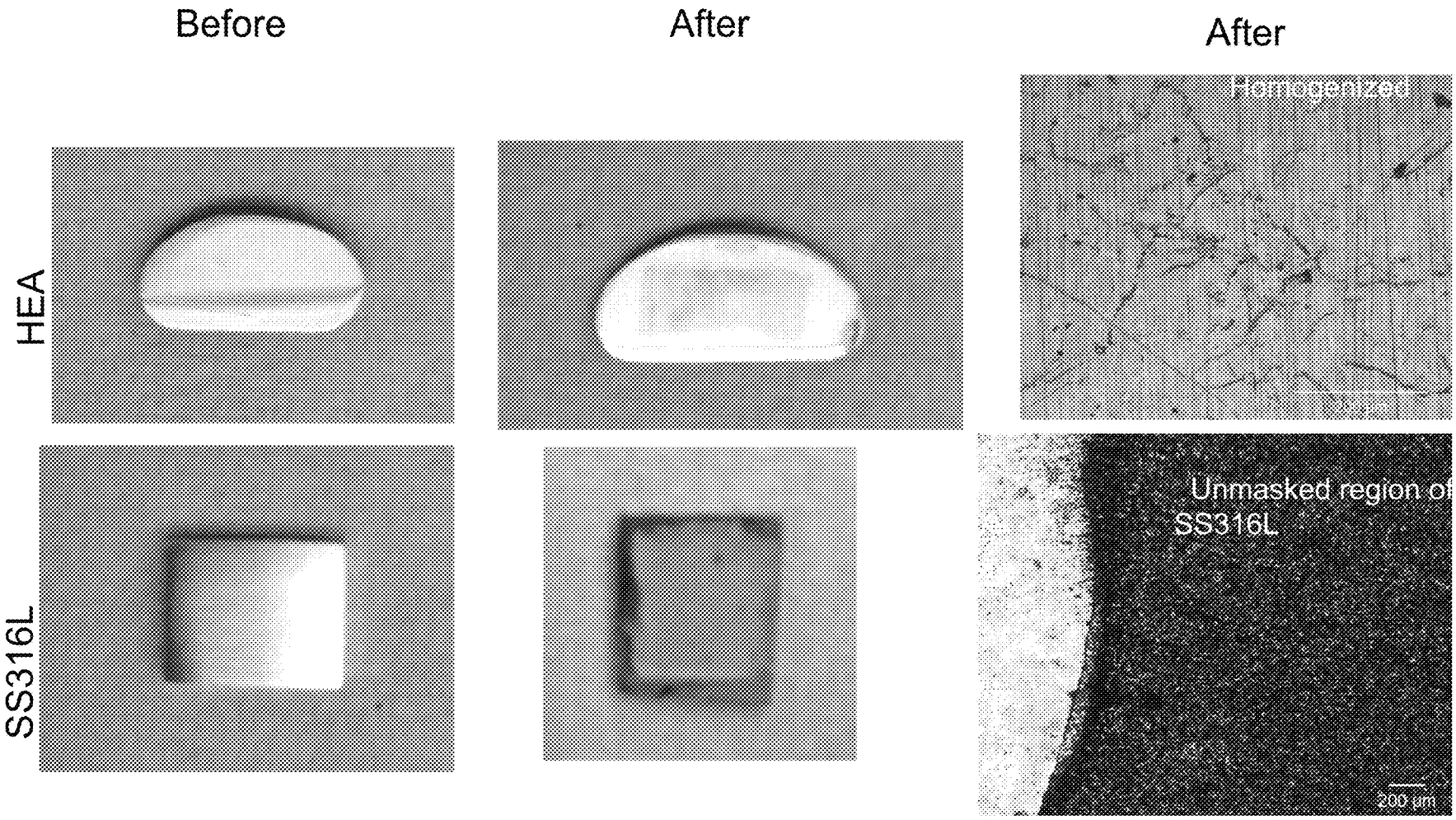
FIG. 1 shows photographs of an example complex concentrated alloy (CCA) and a 316L alloy sample before and after a corrosion resistance experiment.

Materials, methods and techniques disclosed and contemplated herein relate to complex concentrated alloys. Generally, complex concentrated alloys include five or more components and have high configurational entropy. Complex concentrated alloys disclosed and contemplated herein include nickel (Ni), chromium (Cr), iron (Fe), ruthenium (Ru), molybdenum (Mo), and/or tungsten (W). Each of the five or more components are not necessarily present in equal amounts.

In some instances, example CCAs disclosed and contemplated herein can display improved corrosion resistance in harsh environments, for instance, when compared to alloys based on a single majority host element. Example applications of CCAs disclosed and contemplated herein include aerospace, automotive, energy industries, as well as other applications where materials can be subjected to extreme temperature and loading conditions. Example applications of CCAs disclosed and contemplated herein also include those requiring materials that have high strength, are ductile, and are corrosion resistant. Various manufactured articles can be prepared using the CCAs disclosed herein, including for the aforementioned industries and the aforementioned applications.

I. Definitions

Unless otherwise defined, all technical and scientific terms used herein have the same meaning as commonly understood by one of ordinary skill in the art. In case of conflict, the present document, including definitions, will control. Example methods and materials are described below, although methods and materials similar or equivalent to those described herein can be used in practice or testing of the present disclosure. The materials, methods, and examples disclosed herein are illustrative only and not intended to be limiting.

The terms "comprise(s)," "include(s)," "having," "has," "can," "contain(s)," and variants thereof, as used herein, are intended to be open-ended transitional phrases, terms, or words that do not preclude the possibility of additional acts or structures. The singular forms "a," "an" and "the" include plural references unless the context clearly dictates otherwise. The present disclosure also contemplates other embodiments "comprising," "consisting of" and "consisting essentially of," the embodiments or elements presented herein, whether explicitly set forth or not.

As used herein, the term "atmospheric pressure" refers to the pressure of the external environment at the location at which the system and/or the process of the present disclosure is operated. As used herein, the term "ambient pressure" refers to the pressure of the external environment at the location at which the system and/or the process of the present disclosure is operated. The ambient pressure is typically atmospheric pressure.

Definitions of specific functional groups and chemical terms are described in more detail below. For purposes of this disclosure, the chemical elements are identified in accordance with the Periodic Table of the Elements, CAS version, Handbook of Chemistry and Physics, $75^{th}$ Ed., inside cover, and specific functional groups are generally defined as described therein.

For the recitation of numeric ranges herein, each intervening number there between with the same degree of precision is explicitly contemplated. Each numeric range is inclusive of the end points. For example, for the range of 6-9, the numbers 7 and 8 are contemplated in addition to 6 and 9, and for the range 6.0-7.0, the number 6.0, 6.1, 6.2, 6.3, 6.4, 6.5, 6.6, 6.7, 6.8, 6.9, and 7.0 are explicitly contemplated.

The modifier "about" used in connection with a quantity is inclusive of the stated value and has the meaning dictated by the context (for example, it includes at least the degree of error associated with the measurement of the particular quantity). The modifier "about" should also be considered as disclosing the range defined by the absolute values of the two endpoints. For example, the expression "from about 2 to about 4" also discloses the range "from 2 to 4." The term "about" may refer to plus or minus 10% of the indicated number. For example, "about 10%" may indicate a range of 9% to 11%, and "about 1" may mean from 0.9-1.1. Other meanings of "about" may be apparent from the context, such as rounding off, so, for example "about 1" may also mean from 0.5 to 1.4.

II. Example Complex Concentrated Alloys

A. Example Components and Amounts

CCAs disclosed and contemplated herein include various components at various amounts. As used herein, "complex concentrated alloy" means an alloy with at least five elements having a relatively high degree of configurational entropy. Notably, CCAs disclosed and contemplated herein are not necessarily equiatomic and, in fact, many CCAs disclosed herein are not equiatomic. Complex concentrated alloys disclosed and contemplated herein include nickel (Ni), chromium (Cr), iron (Fe), ruthenium (Ru), molybdenum (Mo), and/or tungsten (W).

CCAs disclosed and contemplated herein include nickel (Ni). In various implementations, CCAs include 34-49 atomic percent ("at %") Ni; 34-40 at % Ni; 39-49 at % Ni; 38-44 at % Ni; or 40-46 at % Ni. In various implementations, CCAs include no greater than 49 at % Ni. As an example, CCAs include no greater than 48 at % Ni; no greater than 47 at % Ni; no greater than 46 at % Ni; no greater than 45 at % Ni; no greater than 44 at % Ni; no greater than 43 at % Ni; no greater than 44 at % Ni; no greater than 43 at % Ni; no greater than 42 at % Ni; no greater than 41 at % Ni; no greater than 40 at % Ni; no greater than 39 at % Ni; no greater than 38 at % Ni; no greater than 37 at % Ni; no greater than 36 at % Ni; no greater than 35 at % Ni; or no greater than 34 at %. In various implementations, CCAs include no less than 34 at % Ni. As an example, CCAs include no less than 48 at % Ni; no less than 47 at % Ni; no less than 46 at % Ni; no less than 45 at % Ni; no less than 44 at % Ni; no less than 43 at % Ni;

no less than 44 at % Ni; no less than 43 at % Ni; no less than 42 at % Ni; no less than 41 at % Ni; no less than 40 at % Ni; no less than 39 at % Ni; no less than 38 at % Ni; no less than 37 at % Ni; no less than 36 at % Ni; no less than 35 at % Ni; or no less than 34 at %.

CCAs disclosed and contemplated herein can include chromium (Cr). In various implementations, CCAs include 16-29 at % Cr; 16-21 at % Cr; 21-29 at % Cr; 19-26 at % Cr; 20-24 at % Cr; or 17-22 at % Cr. In various implementations, CCAs include no greater than 29 at % Cr. As an example, CCAs include no greater than 28 at % Cr; no greater than 27 at % Cr; no greater than 26 at % Cr; no greater than 25 at % Cr; no greater than 24 at % Cr; no greater than 23 at % Cr; no greater than 22 at % Cr; no greater than 21 at % Cr; no greater than 20 at % Cr; no greater than 19 at % Cr; no greater than 18 at % Cr; no greater than 17 at % Cr. In various implementations, CCAs include no less than 16 at % Cr. As an example, CCAs include no less than 28 at % Cr; no less than 27 at % Cr; no less than 26 at % Cr; no less than 25 at % Cr; no less than 24 at % Cr; no less than 23 at % Cr; no less than 22 at % Cr; no less than 21 at % Cr; no less than 20 at % Cr; no less than 19 at % Cr; no less than 18 at % Cr; no less than 17 at % Cr.

CCAs disclosed and contemplated herein can include iron (Fe). In various implementations, CCAs include 15-33 at % Fe; 15-24 at % Fe; 25-33 at % Fe; 19-29 at % Fe; 22-26 at % Fe; or 17-21 at % Fe. In various implementations, CCAs include no greater than 33 at % Fe. As an example, CCAs include no greater than 32 at % Fe; no greater than 31 at % Fe; no greater than 30 at % Fe; no greater than 29 at % Fe; no greater than 28 at % Fe; no greater than 27 at % Fe; no greater than 26 at % Fe; no greater than 25 at % Fe; no greater than 24 at % Fe; no greater than 23 at % Fe; no greater than 22 at % Fe; no greater than 21 at % Fe; no greater than 20 at % Fe; no greater than 19 at % Fe; no greater than 18 at % Fe; no greater than 17 at % Fe; no greater than 16 at % Fe. In various implementations, CCAs include no less than 15 at % Fe. As an example, CCAs include no less than 32 at % Fe; no less than 31 at % Fe; no less than 30 at % Fe; no less than 29 at % Fe; no less than 28 at % Fe; no less than 27 at % Fe; no less than 26 at % Fe; no less than 25 at % Fe; no less than 24 at % Fe; no less than 23 at % Fe; no less than 22 at % Fe; no less than 21 at % Fe; no less than 20 at % Fe; no less than 19 at % Fe; no less than 18 at % Fe; no less than 17 at % Fe; no less than 16 at % Fe.

CCAs disclosed and contemplated herein can include ruthenium (Ru). In various implementations, CCAs include 3-18 at % Ru; 3-10 at % Ru; 11-18 at % Ru; 5-16 at % Ru; 7-14 at % Ru; 4-12 at % Ru; 9-16 at % Ru; or 8-11 at % Ru. In various implementations, CCAs include no greater than 18 at % Ru. As an example, CCAs include no greater than 17 at % Ru; no greater than 16 at % Ru; no greater than 15 at % Ru; no greater than 14 at % Ru; no greater than 13 at % Ru; no greater than 12 at % Ru; no greater than 11 at % Ru; no greater than 10 at % Ru; no greater than 9 at % Ru; no greater than 8 at % Ru; no greater than 7 at % Ru; no greater than 6 at % Ru; no greater than 5 at % Ru; no greater than 4 at % Ru. In various implementations, CCAs include no less than 3 at % Ru. As an example, CCAs include no less than 17 at % Ru; no less than 16 at % Ru; no less than 15 at % Ru; no less than 14 at % Ru; no less than 13 at % Ru; no less than 12 at % Ru; no less than 11 at % Ru; no less than 10 at % Ru; no less than 9 at % Ru; no less than 8 at % Ru; no less than 7 at % Ru; no less than 6 at % Ru; no less than 5 at % Ru; no less than 4 at % Ru.

CCAs disclosed and contemplated herein can include molybdenum (Mo). In various implementations, CCAs include 4-8 at % Mo; 5-7 at % Mo; 4-6 at % Mo; 6-8 at % Mo; 5-8 at % Mo; 4-7 at % Mo; or 6-7 at % Mo. In various implementations, CCAs include no greater than 8 at % Mo. As an example, CCAs include no greater than 7 at % Mo; no greater than 6 at % Mo; or no greater than 5 at % Mo. In various implementations, CCAs include no less than 4% Mo. As an example, CCAs include no less than 7 at % Mo; no less than 6 at % Mo; or no less than 5 at % Mo.

CCAs disclosed and contemplated herein can include tungsten (W). In various implementations, CCAs include 1-3.5 at % W; 1-3 at % W; 1-2 at % W; 2-3 at % W; or 2-3.5 at % W. In various implementations, CCAs include no greater than 3.5 at % W; no greater than 3 at % W; or no greater than 2 at % W. In various implementations, CCAs include no less than 1 at % W; no less than 2 at % W; or no less than 3 at % W.

In some implementations, CCAs include 16-29 at % Cr; 15-33 at % Fe; 2-18 at % Ru; 3-8 at % Mo; 1-3.5 at % W, and the balance of atomic percent comprising nickel and incidental elements and impurities. In some implementations, CCAs include 16-29 at % Cr; 15-33 at % Fe; 2-13 at % Ru; 3-8 at % Mo; 1-3.5 at % W, and the balance of atomic percent comprising nickel and incidental elements and impurities. In some implementations, CCAs include 16-29 at % Cr; 15-33 at % Fe; 2-8 at % Ru; 3-8 at % Mo; 1-3.5 at % W, and the balance of atomic percent comprising nickel and incidental elements and impurities. In some implementations, CCAs include 16-29 at % Cr; 15-33 at % Fe; 2-5 at % Ru; 3-8 at % Mo; 1-3.5 at % W, and the balance of atomic percent comprising nickel and incidental elements and impurities. In some implementations, CCAs include 16-29 at % Cr; 15-33 at % Fe; 2-18 at % Ru; 3-8 at % Mo; 1-3.5 at % W; 34-49 at % Ni, and the balance of atomic percent comprising incidental elements and impurities. In some implementations, CCAs include 16-29 at % Cr; 15-33 at % Fe; 2-18 at % Ru; 3-8 at % Mo; 1-3.5 at % W; 38-49 at % Ni, and the balance of atomic percent comprising incidental elements and impurities.

Incidental elements and impurities in the disclosed CCAs may include, but are not limited to, silicon, vanadium, titanium, or mixtures thereof, and may be present in the alloys disclosed herein in amounts totaling no more than 1%, no more than 0.9%, no more than 0.8%, no more than 0.7%, no more than 0.6%, no more than 0.5%, no more than 0.4%, no more than 0.3%, no more than 0.2%, no more than 0.1%, no more than 0.05%, no more than 0.01%, or no more than 0.001%.

It is understood that the alloys described herein may consist only of the above-mentioned constituents, may consist essentially of such constituents, or, in other embodiments, may include additional constituents.

B. Example Pitting Resistance Equivalent Number Characteristics

Pitting Resistance Equivalent Number (PREN) is an empirical linearization equation of the wt % of certain constituent alloy elements. PREN has been used to measure corrosion resistance of Fe- and Ni-based alloys, such as stainless steels and superalloys. Generally, higher PREN values indicate greater corrosion resistance. PREN for stainless steels including tungsten can be calculated using equation (3), below:

$$PREN=\%\ Cr+3.3(\%\ Mo+0.5\%\ W)+16\%\ N \quad (3)$$

It will be appreciated that applying PREN to the instantly disclosed CCA is an imperfect fit because CCAs lack a principal "base element" and there is inherent structural and/or compositional complexities of CCAs that might not be found in stainless steels and/or superalloys. However, various implementations of CCAs disclosed and contemplated herein have a PREN value of no less than 47. As an example, CCAs disclosed and contemplated herein have a PREN value of no less than 50; of no less than 54; of no less than 58; of no less than 60; or of no less than 62.

C. Example Phase Microstructure and Distribution

CCAs disclosed and contemplated herein can be characterized by phase microstructure and/or distribution. Without being bound by a particular theory, it appears that Ru in the CCAs disclosed and contemplated herein can suppress second-phase precipitation and can promote single phase formation in favor of structural homogeneity, thereby reducing localized corrosion attack.

Typically, CCAs disclosed and contemplated herein have a single phase microstructure. Often, the single phase microstructure is face-centered-cubic (FCC). In some instances, CCAs disclosed and contemplated herein are homogenous and have a single phase microstructure of FCC. Again, without being bound by a particular theory, it is theorized that the single phase microstructure of FCC results in improved corrosion resistance of CCAs.

In some instances, composition homogeneity can be evaluated by Energy Dispersive x-ray Spectroscopy (EDS) mapping. In some instances, X-Ray Diffraction (XRD) can be conducted on samples to determine phase microstructure of the alloy.

D. Example Methods of Manufacture

CCAs disclosed and contemplated herein can be formed using complex concentrated alloy fabrication techniques. For example, a method for producing a complex concentrated alloy includes preparing a melt that includes at least five of the components provided above. For instance, the melt can include, in atomic percentage, 16% to 29% Cr, 15% to 33% Fe, 2% to 18% Ru, 4% to 8% Mo, 1% to 3.5% W, and the balance of atomic percent comprising nickel and incidental elements and impurities.

In an example implementation, the method can include arc-melting. In some instances, the arc-melting can be conducted under a zirconium-gettered atmosphere of argon in a water-cooled bath. In some instances, a CCA composition can be re-melted multiple times, even up to 5 times, 10 times, or more. In some instances, a CCA composition can be homogenized, which can include vacuum encapsulation in a quartz tube, furnace heat treatment (e.g., at 1250° C. for 96 hours), and fast quenching in ice water. Minimum furnace heat treatment temperatures can be selected based on a lower temperature boundary line of a single phase FCC region as shown in a phase diagram, and also can be selected based on the composition components. Typically, however, solutionizing material at temperatures greater than that boundary can accelerate the solutionizing process.

III. Experimental Examples

A. Experimental Example of Corrosion Resistance Determination

Experimental corrosion resistance data were obtained for an example embodiment of a CCA and for an example commercial stainless steel, 316L. Corrosion resistance was measured experimentally by exposing samples to 12M HCl for 24 hours. Before and after the experiment, various parameters can be obtained and/or measured. For example, micrographs, weight, density, mass, width, and length can be obtained for a sample. Corrosion rate was calculated using equation 4, below:

$$\text{Corrosion Rate} = \frac{(K)(W)}{(A)(T)(D)} \tag{4}$$

where K is a constant, for example, $3.45\times10^6$ mm; W is mass loss; A is exposed area; T is time (typically, 24 hours for these experiments); and D is density of the material. An example embodiment of a CCA had a density of 6 g/cm$^3$ and a sample of 316L had a density of 8 g/cm$^3$. Corrosion rate was calculated in mpy (millimeters per year).

Four samples of 316L were tested. Sample 1 had a corrosion rate of 1680 mpy; Sample 2 had a corrosion rate of 1980 mpy; Sample 3 had a corrosion rate of 2020 mpy; and Sample 4 had a corrosion rate of 1670 mpy. Two samples of example CCAs were tested. Sample 1 had a corrosion rate of 0 mpy; Sample 2 had a corrosion rate of 147 mpy.

FIG. 1 shows photographs of the example CCA and 316L samples before and after the corrosion resistance experiments. FIG. 1 also shows micrographs of surfaces of the CCA and 316L samples after the corrosion resistance experiments.

B. Experimental Examples of Complex Concentrated Alloys

Seven experimental examples of CCAs were manufactured at the lab scale and characterized by XRD and SEM/EDS to identify microstructure. The seven CCA experimental examples were fabricated via arc melting at the 15-20 g "button" scale. The arc melting was conducted under a zirconium-gettered atmosphere of argon in a water-cooled hearth. To ensure homogeneity, the buttons were flipped over and re-melted multiple times (5-10 times per button) in the arc-melter. Each button was subsequently homogenized, which consisted of vacuum encapsulation in a quartz tube, furnace heat treatment at 1250° C. for 96 hours, and fast quenching in ice-water. Composition homogeneity of the samples was first evaluated by Energy Dispersive x-ray Spectroscopy (EDS) mapping, and if the homogeneity was confirmed, X-ray diffraction (XRD) was then conducted on the homogenized samples to verify the FCC single-phase microstructure as computationally predicted. The seven experimental examples are provided in Table 1 below. For comparison purposes, certain data for C-22 alloy are also provided in Table 1. C-22 is an existing commercial alloy regarded to be highly corrosion resistant.

TABLE 1

Experimental example test alloys and certain experimental data thereof.

| Test | Alloy composition (at %) | | | | | | $\Delta S_{config}$ | | Homog- | Single phase by |
|---|---|---|---|---|---|---|---|---|---|---|
| Alloy | Ni | Cr | Fe | Ru | Mo | W | (R) | PREN | enized? | XRD? |
| #1 | 38 | 21 | 20 | 13 | 6 | 2 | 1.53 | 54 | YES | YES |
| #2 | 38 | 26 | 20 | 8 | 6 | 2 | 1.49 | 60 | YES | YES |
| #3 | 38 | 29 | 20 | 5 | 6 | 2 | 1.44 | 64 | YES | YES |
| #4 | 44 | 21 | 20 | 7 | 6 | 2 | 1.44 | 56 | YES | N/A |
| #5 | 49 | 21 | 20 | 2 | 6 | 2 | 1.3 | 53 | YES | YES |
| #6 | 38 | 21 | 25 | 8 | 6 | 2 | 1.5 | 56 | YES | YES |
| #7 | 38 | 21 | 30 | 3 | 6 | 2 | 1.4 | 58 | YES | YES |
| C-22 | 57 | 26 | 3 | — | 8 | 1 | 1.22 | 72 | — | — |

Phase diagrams for Test Alloys 1-7 were calculated in Thermo-Calc software. Resulting phase diagrams are shown in FIGS. 2-6 and described below. Generally, the phase diagrams in FIGS. 2-6 show varying Ru content with different elements.

Figure 2:
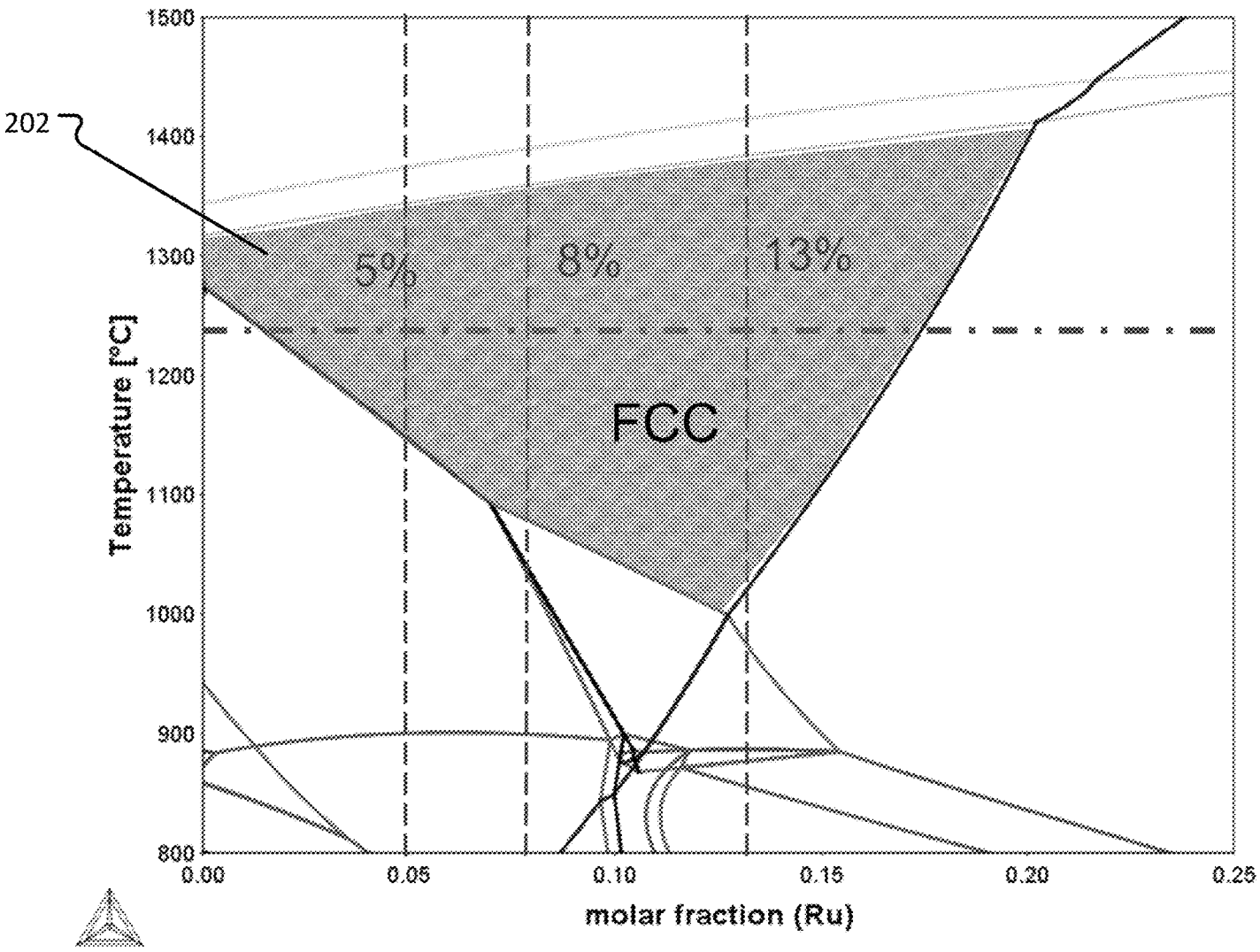
FIG. 2 shows a phase diagram where a sum total of Ru and Cr was held constant at 34 at %.

FIG. 2 shows a phase diagram where a sum total of Ru and Cr was held constant at 34 at %. FIG. 2 also indicates 13% Ru, 8% Ru, and 5% Ru representing Ru amounts in Test Alloys 1, 2, and 3, respectively. A region 202 where FCC single phase microstructure exists is labeled in FIG. 2.

Figure 3:
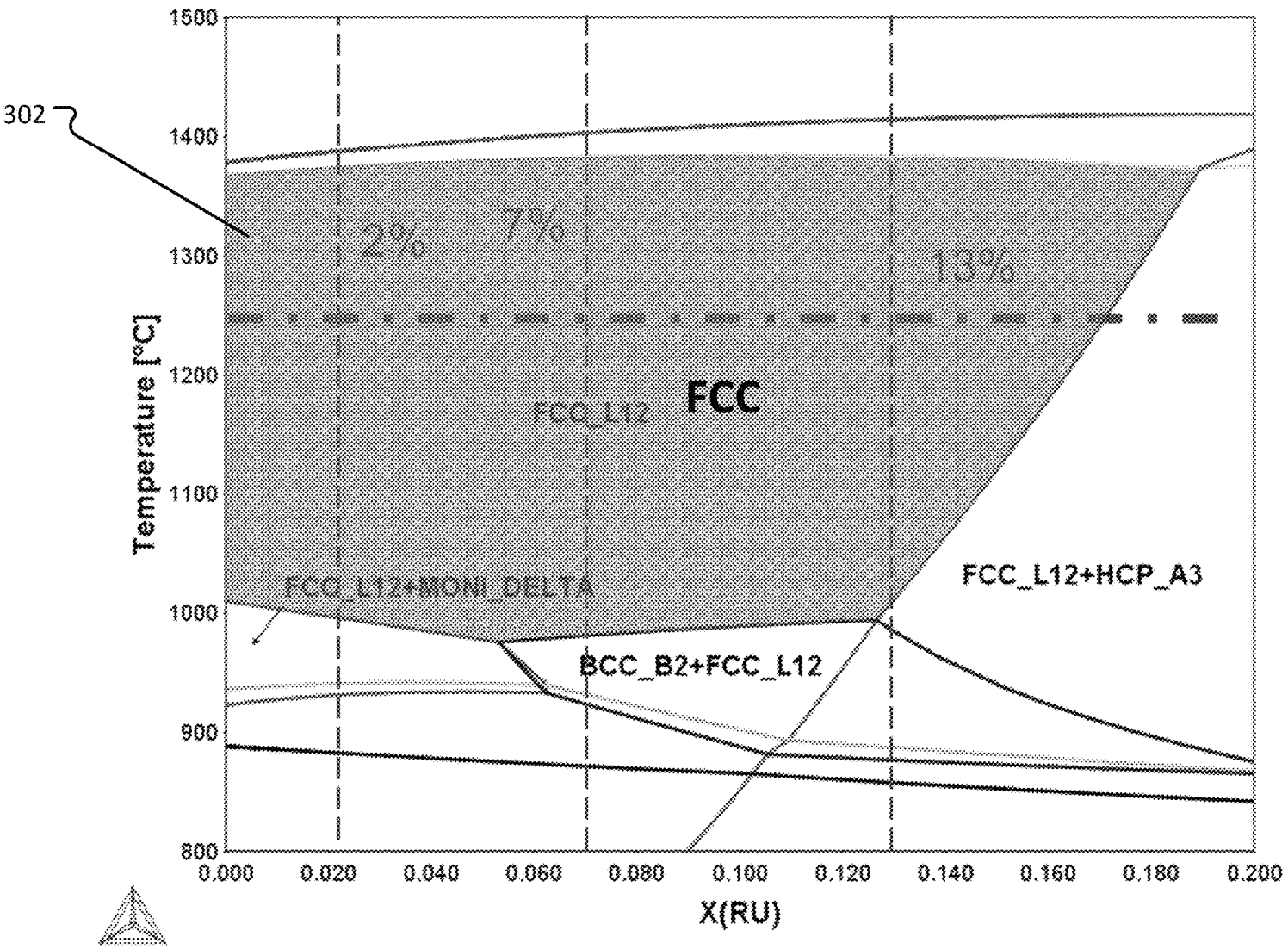
FIG. 3 shows a phase diagram where a sum total of Ru and Ni was held constant at 51 at %.

FIG. 3 shows phase diagrams where a sum total of Ru and Ni was held constant at 51 at %. FIG. 3 also indicates 7% Ru and 2% Ru, representing Ru amounts in Test Alloys 4 and 5, respectively. FIG. 3 also indicates where $\Delta S_{config}$ is less than 1.5 R. A region 302 where FCC single phase microstructure exists is labeled in FIG. 3.

Figure 4:
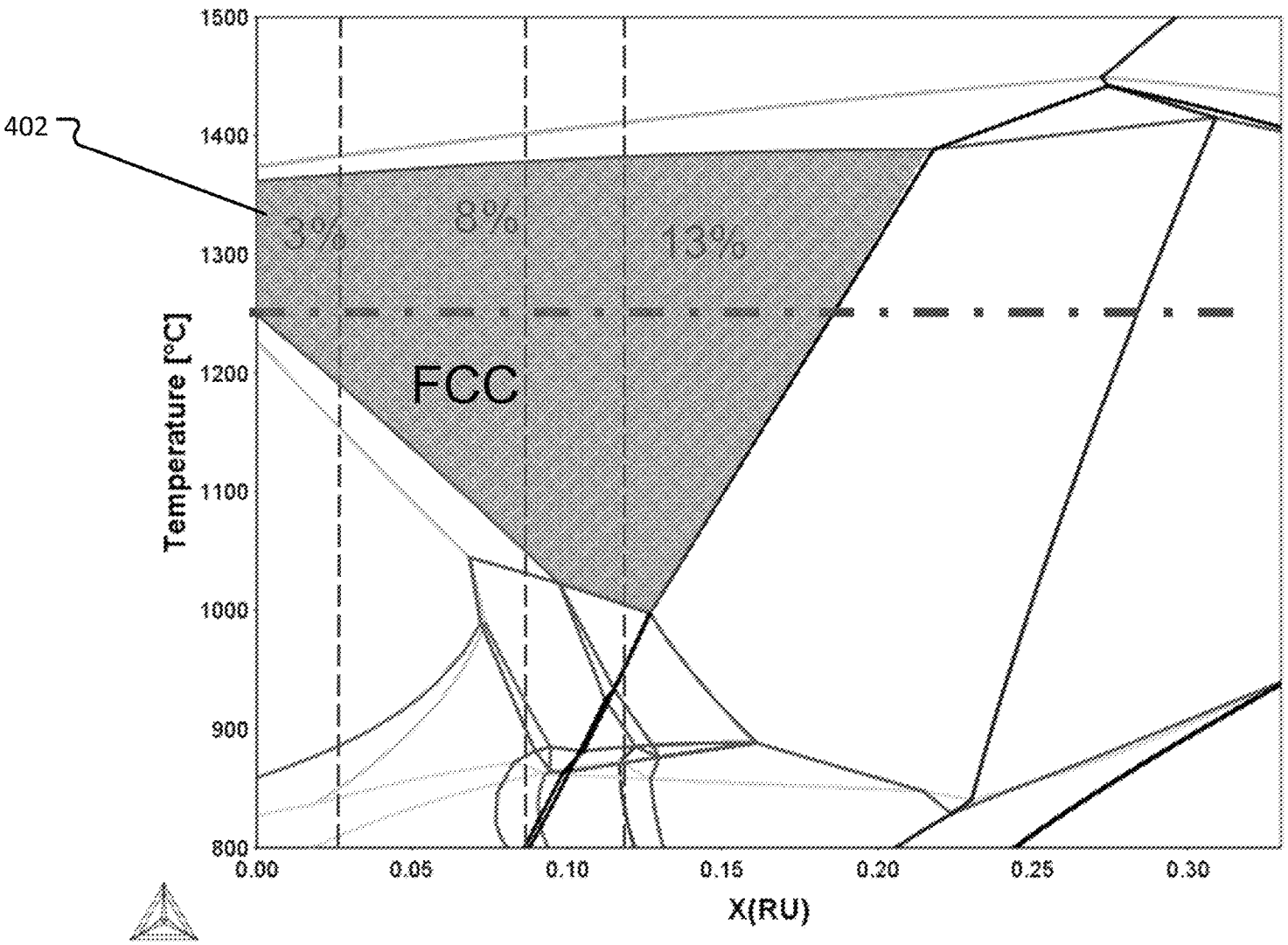
FIG. 4 shows a phase diagram where a sum total of Ru and Fe was held constant at 33 at %.

FIG. 4 shows phase diagrams where a sum total of Ru and Fe was held constant at 33 at %. FIG. 4 also indicates 8% Ru and 3% Ru, representing Ru amounts in Test Alloys 6 and 7, respectively. A region 402 where FCC single phase microstructure exists is labeled in FIG. 4.

Figure 5:
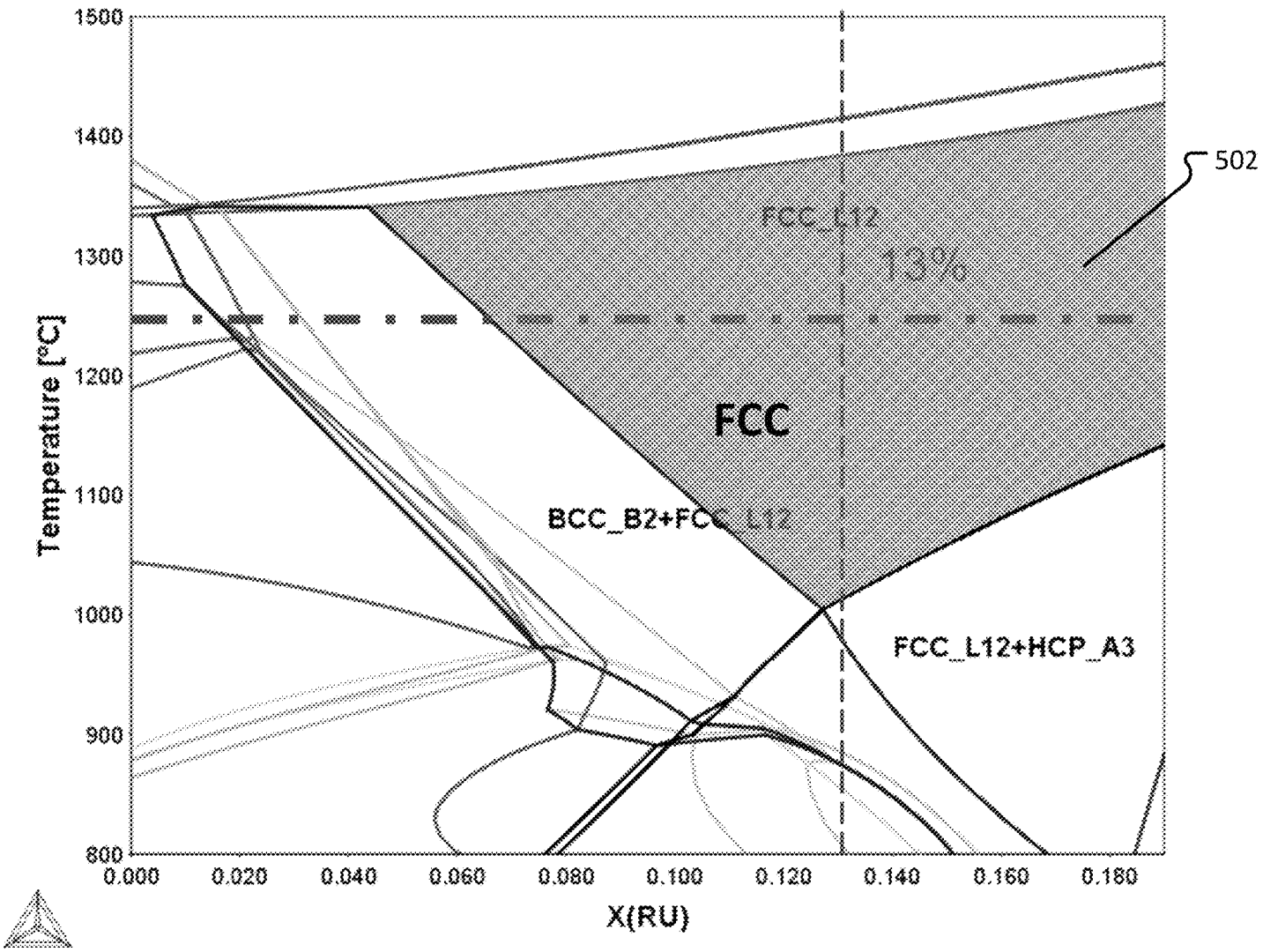
FIG. 5 shows a phase diagram where a sum total of Ru and Mo was held constant at 19 at %.

FIG. 5 shows a phase diagram where a sum total of Ru and Mo was held constant at 19 at %. A region 502 where FCC single phase microstructure exists is labeled in FIG. 5.

Figure 6:
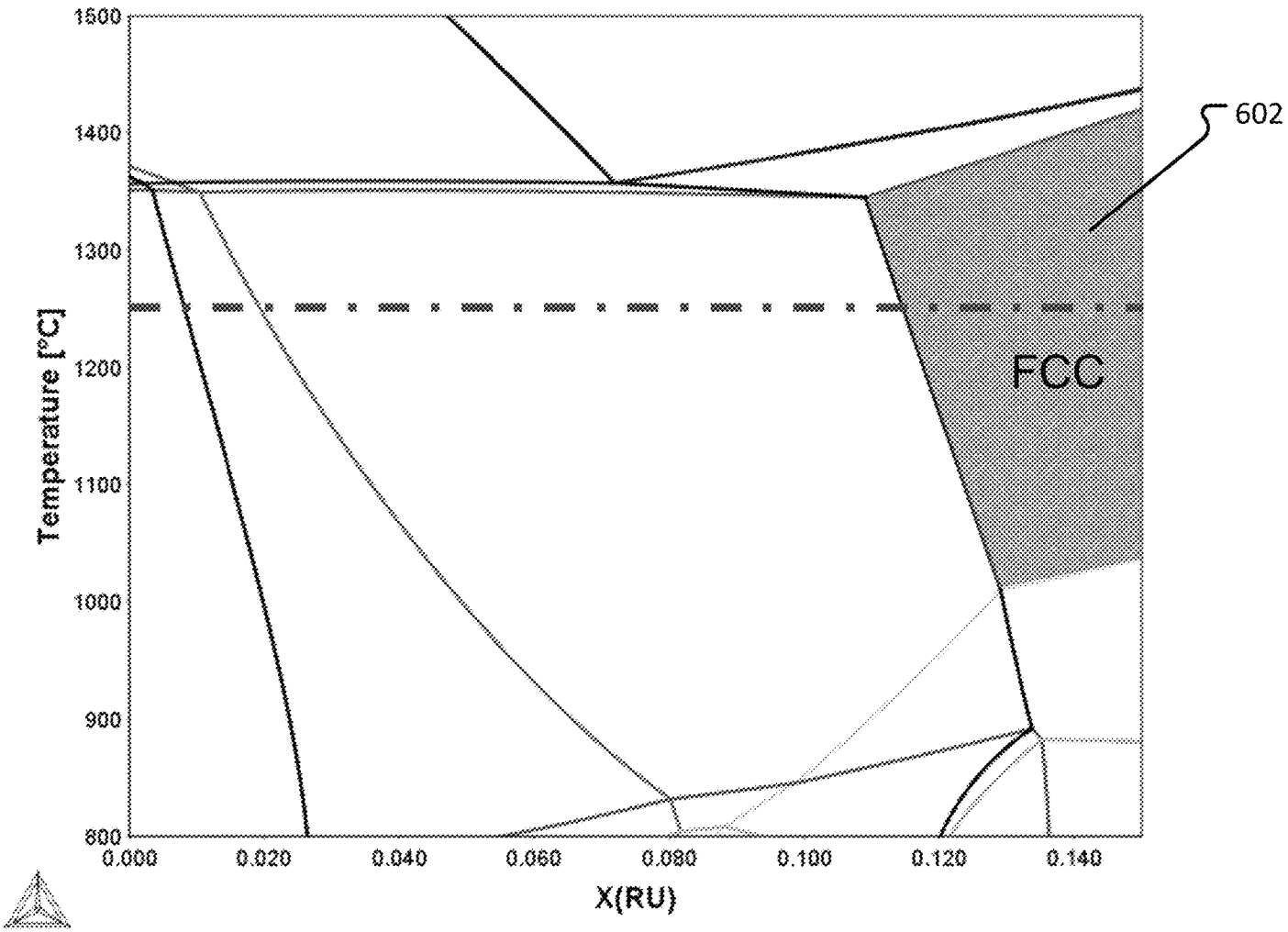
FIG. 6 shows a phase diagram where a sum total of Ru and W was held constant at 15 at %.

FIG. 6 shows a phase diagram where a sum total of Ru and W was held constant at 15 at %. A region 602 where FCC single phase microstructure exists is labeled in FIG. 6.

Each test alloy 1-7 was examined by EDS and XRD and confirmed to be homogenous. EDS was performed with an Oxford X Max 80 detector, which has a 80 $mm^2$ sensor, alloying up to 40,000 counts per second (accuracy about +/−0.2-0.5 wt. %). Acquisitions were performed with the AZtecLive Software. EDS maps were stopped after more than 400,000 counts, line scans after 600,000 counts. X-ray diffraction was performed on a Scintag XD S2000 using copper radiation (Kα, wavelength: 1.540562 nm). The scans were performed at room temperature (40 kV-20 mA) from 30° to 100° at a scan speed of 2 seconds per step and a step size of 0.05°. SEM data were obtained with a Hitachi S4500 Type I, where acquisitions were performed at a voltage of 20 kV with a backscatter detector.

Figure 7A:
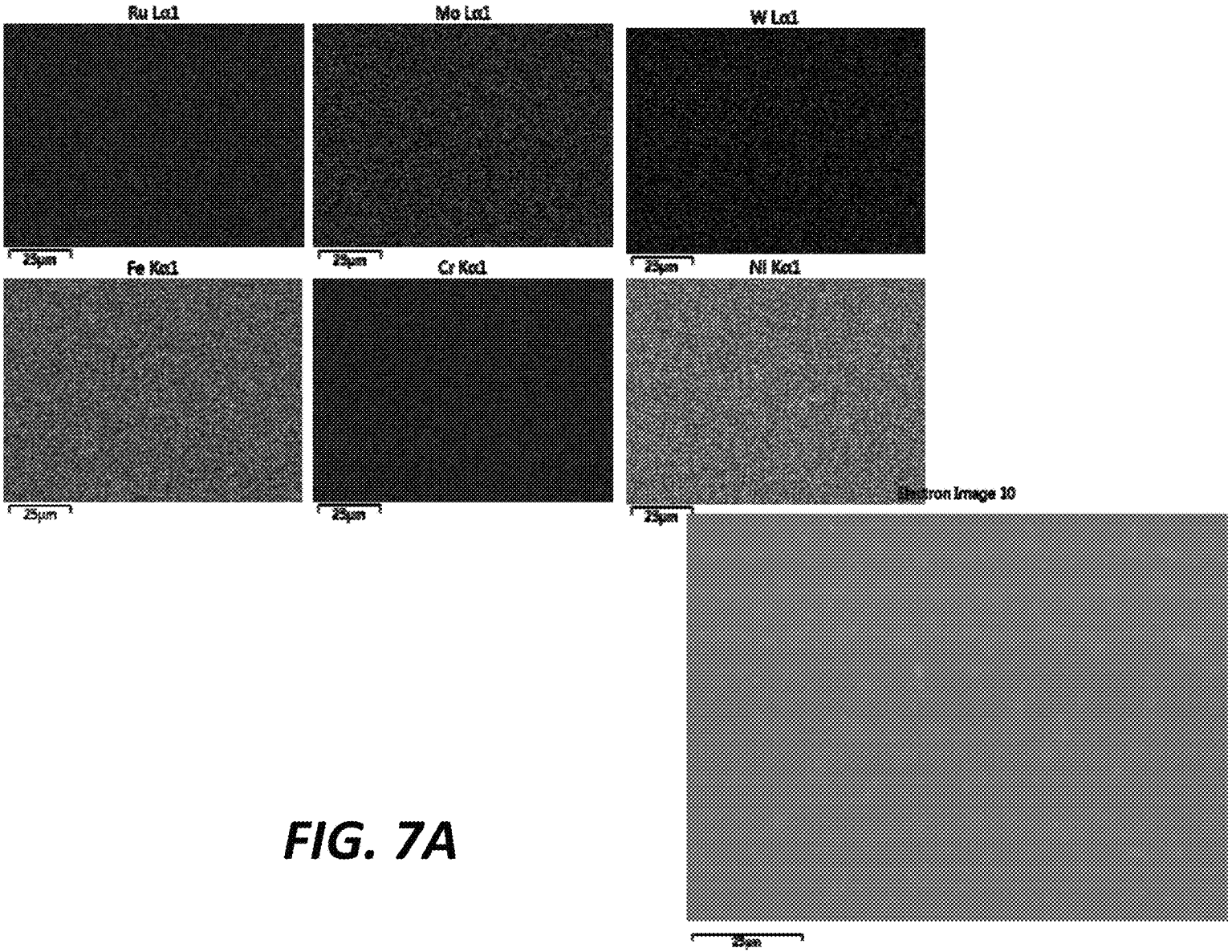
FIGS. 7A and 7B show Scanning Electron Microscopy (SEM)/Energy Dispersive x-ray Spectroscopy (EDS), X-Ray Diffraction (XRD) test results for an example embodiment of a CCA.
Figure 7B:
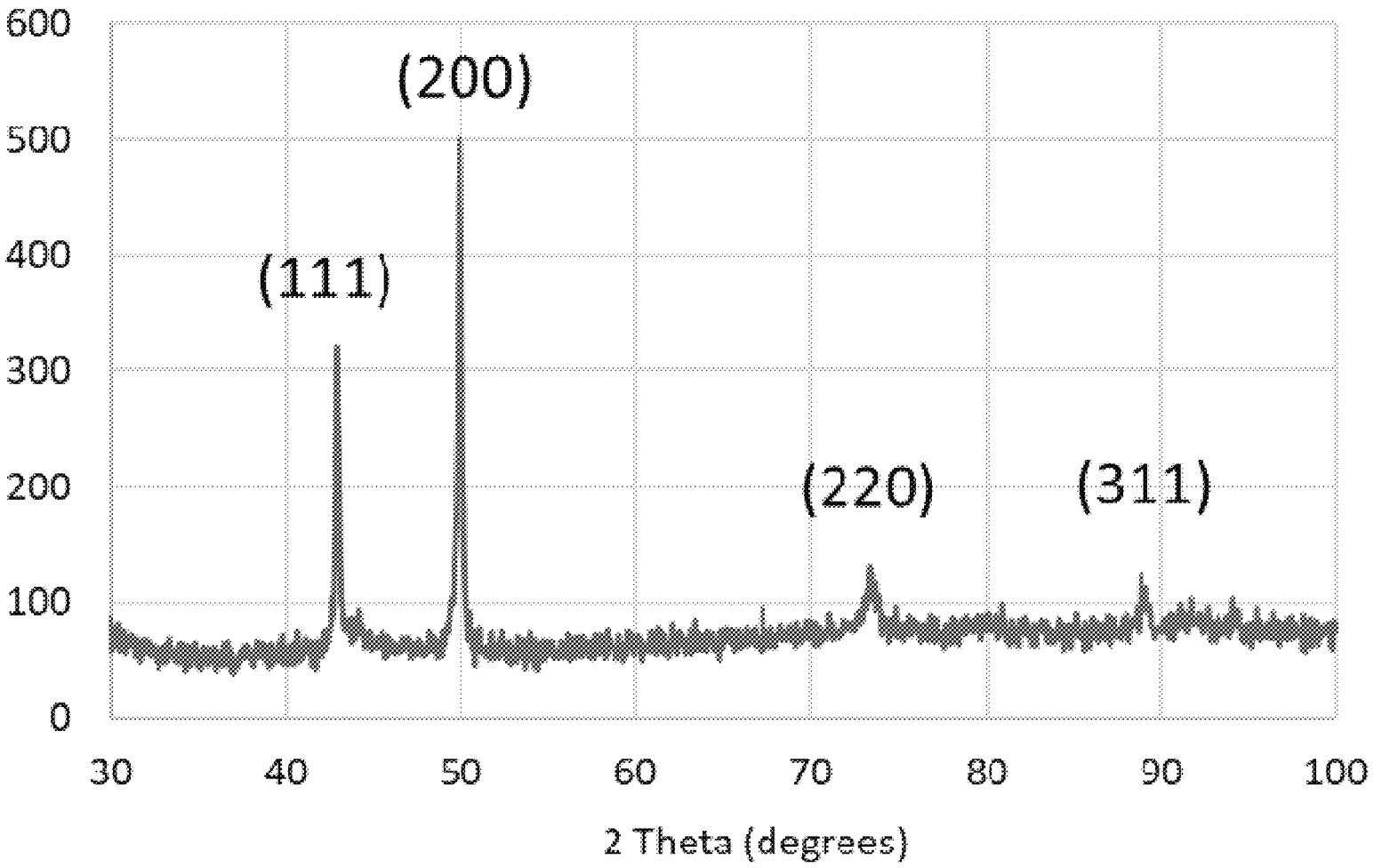

FIGS. 7A and 7B show Scanning Electron Microscopy (SEM)/Energy Dispersive x-ray Spectroscopy (EDS) and X-Ray Diffraction (XRD) results for Test Alloy 1. EDS testing indicated the following atomic percentages: 37.93 (38) at % Ni; 21.81 (21) at % Cr; 20.28 (20) at % Fe; 12.96 (13) at % Ru; 1.77 (2) at % W; and 5.26 (6) at % Mo.

Figure 8A:
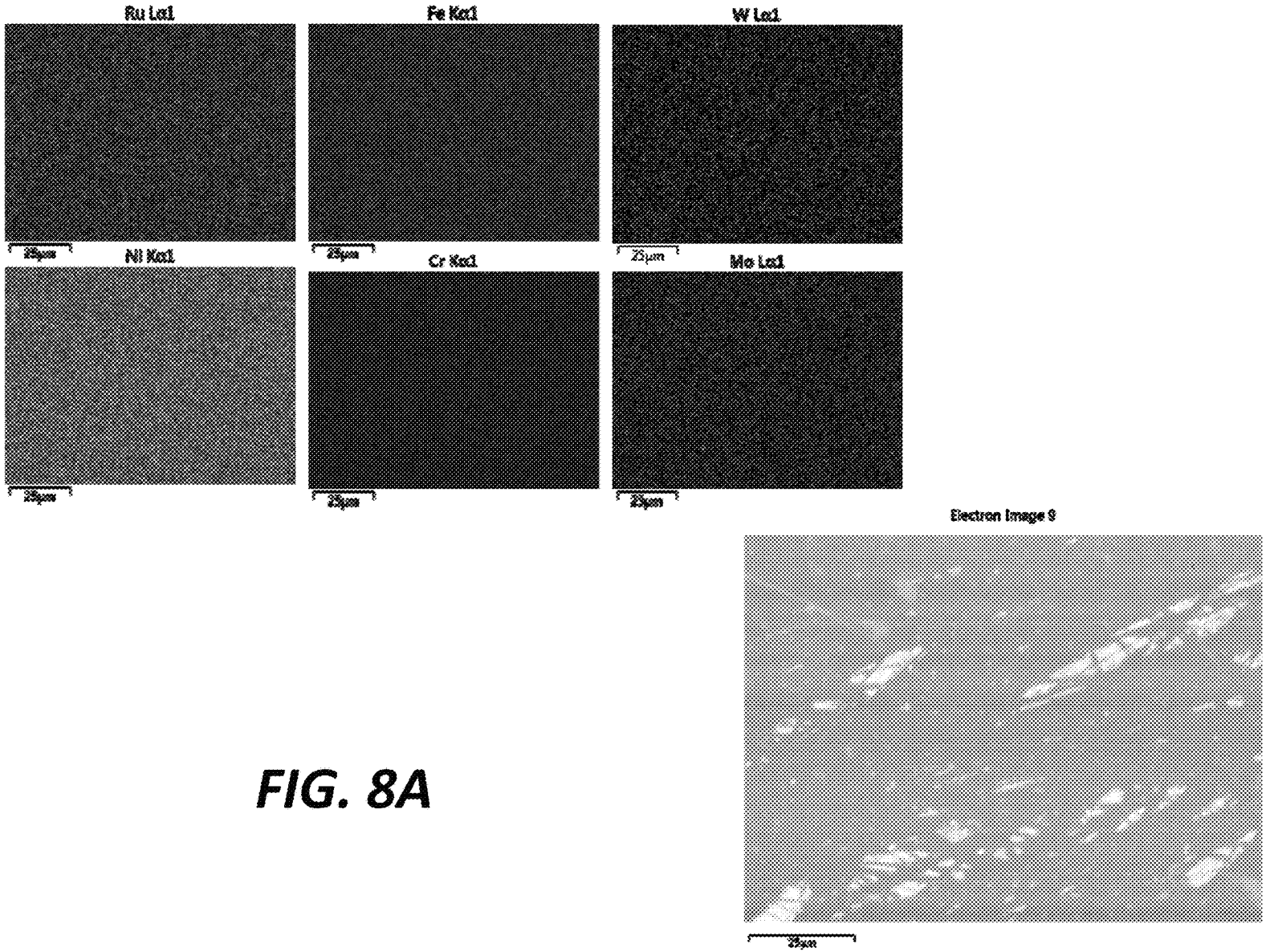
FIGS. 8A and 8B show SEM/EDS and XRD test results for another example embodiment of a CCA.
Figure 8B:
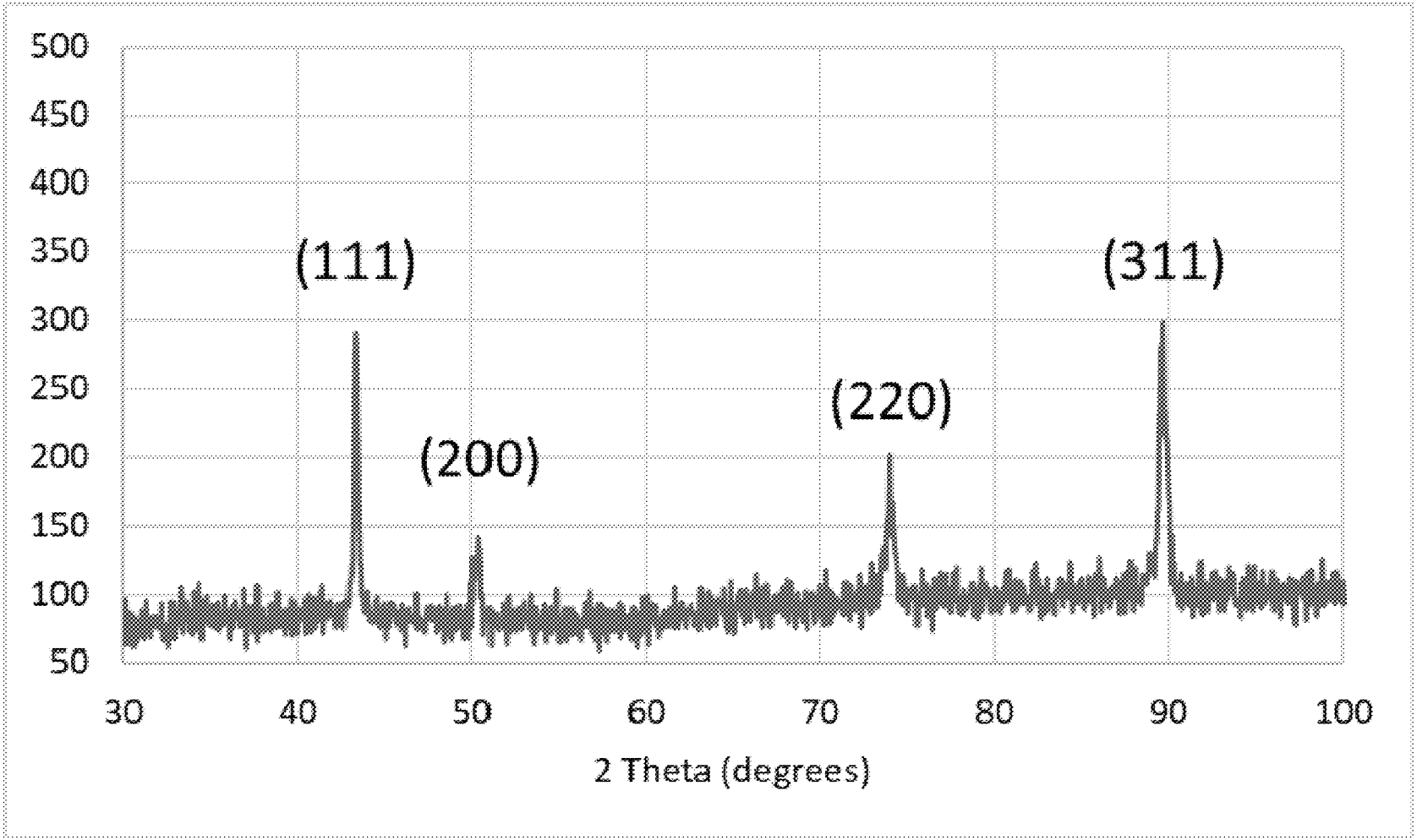

FIGS. 8A and 8B show SEM/EDS and XRD results for Test Alloy 2. EDS testing indicated the following atomic percentages (target in parentheses): 38.46 (38) at % Ni; 27.62 (26) at % Cr; 20.82 (20) at % Fe; 7.98 (8) at % Ru; 1.07 (2) at % W; and 4.07 (6) at % Mo.

Figure 9A:
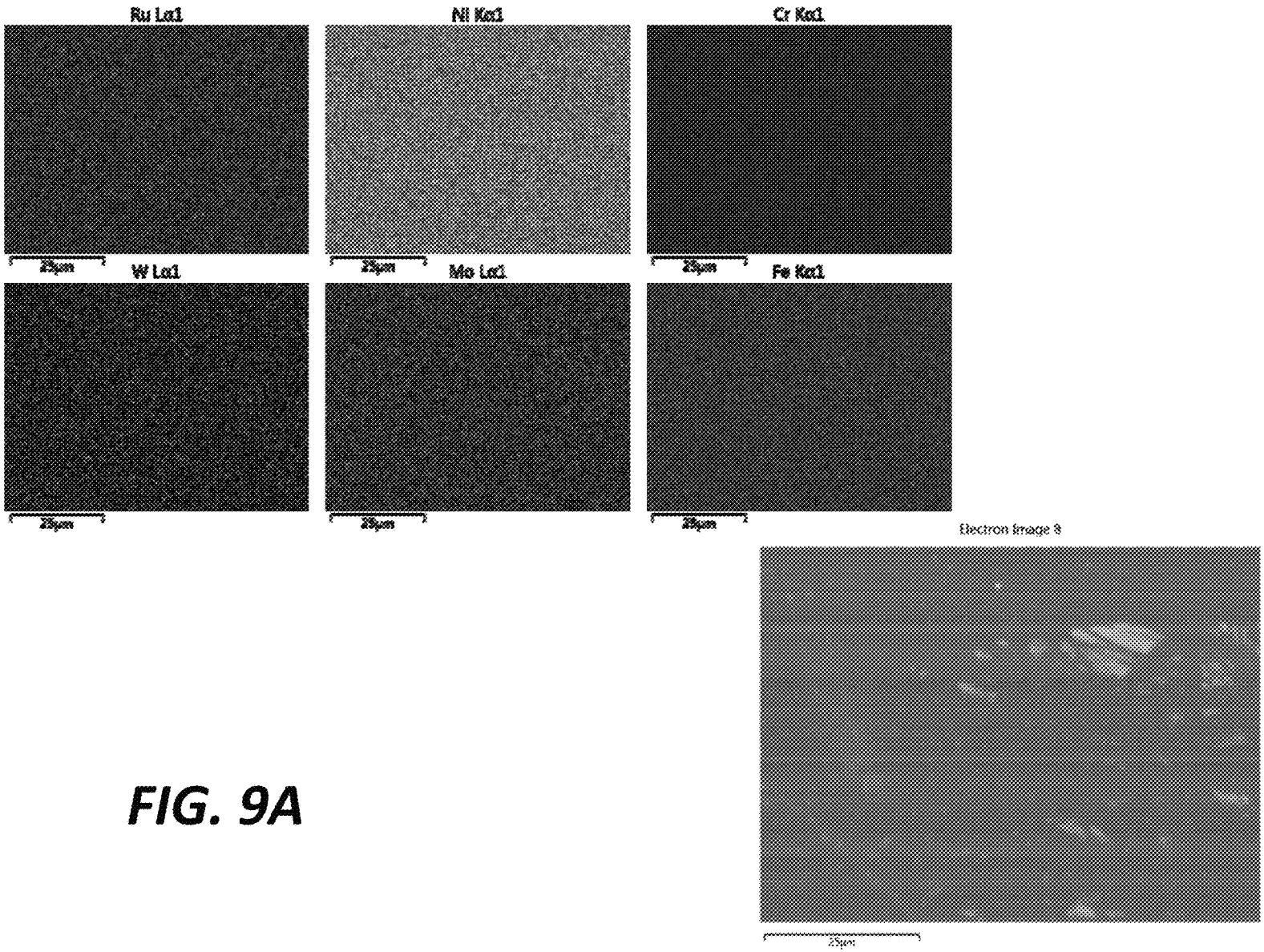
FIGS. 9A and 9B show SEM/EDS and XRD test results for another example embodiment of a CCA.
Figure 9B:
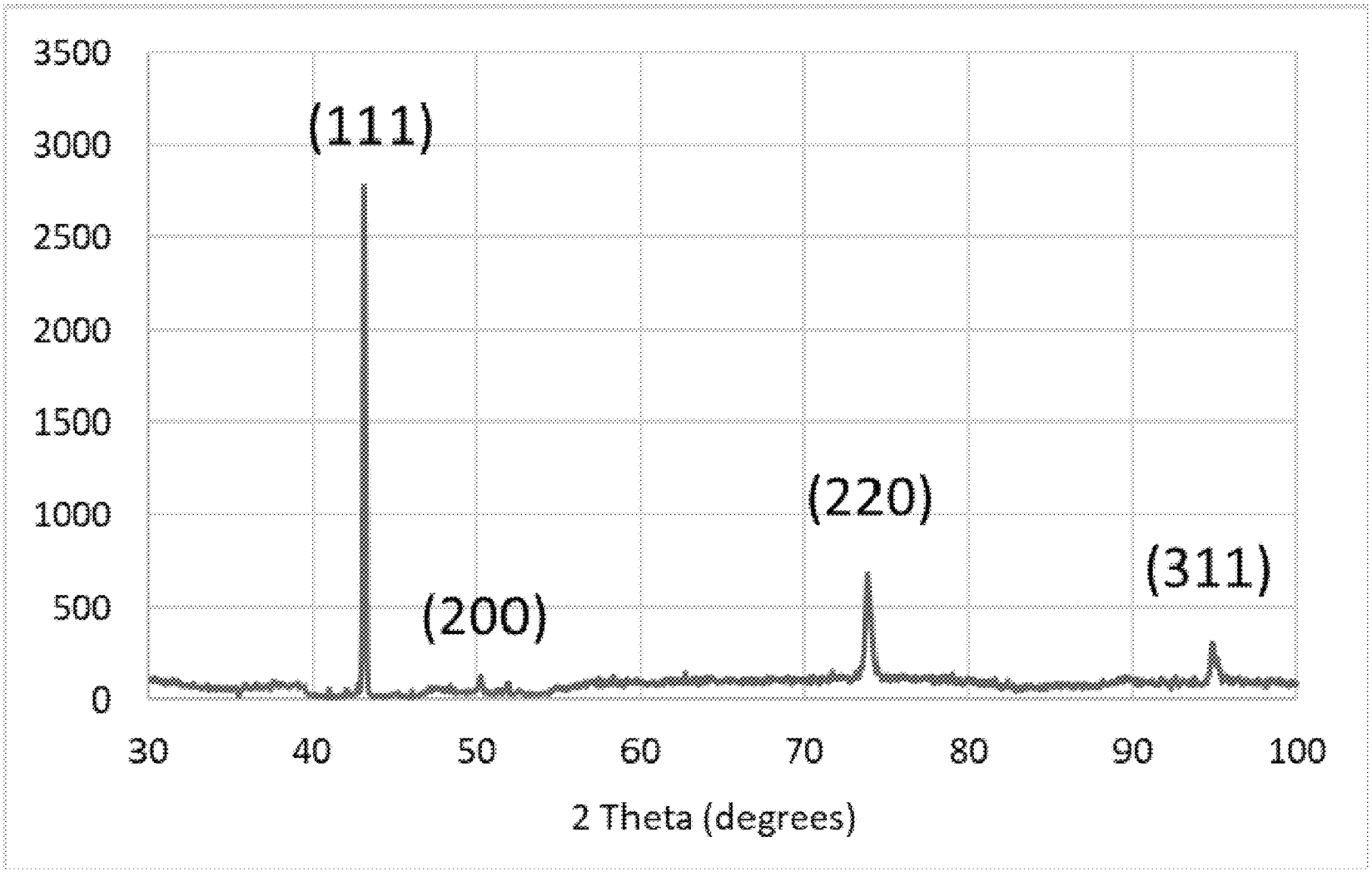

FIGS. 9A and 9B show SEM/EDS and XRD test results for Test Alloy 3. EDS testing indicated the following atomic percentages (target in parentheses): 37.93 (38) at % Ni; 30.30 (29) at % Cr; 20.56 (20) at % Fe; 5.4 (5) at % Ru; 0.94 (2) at % W; and 4.83 (6) at % Mo.

Figure 10:
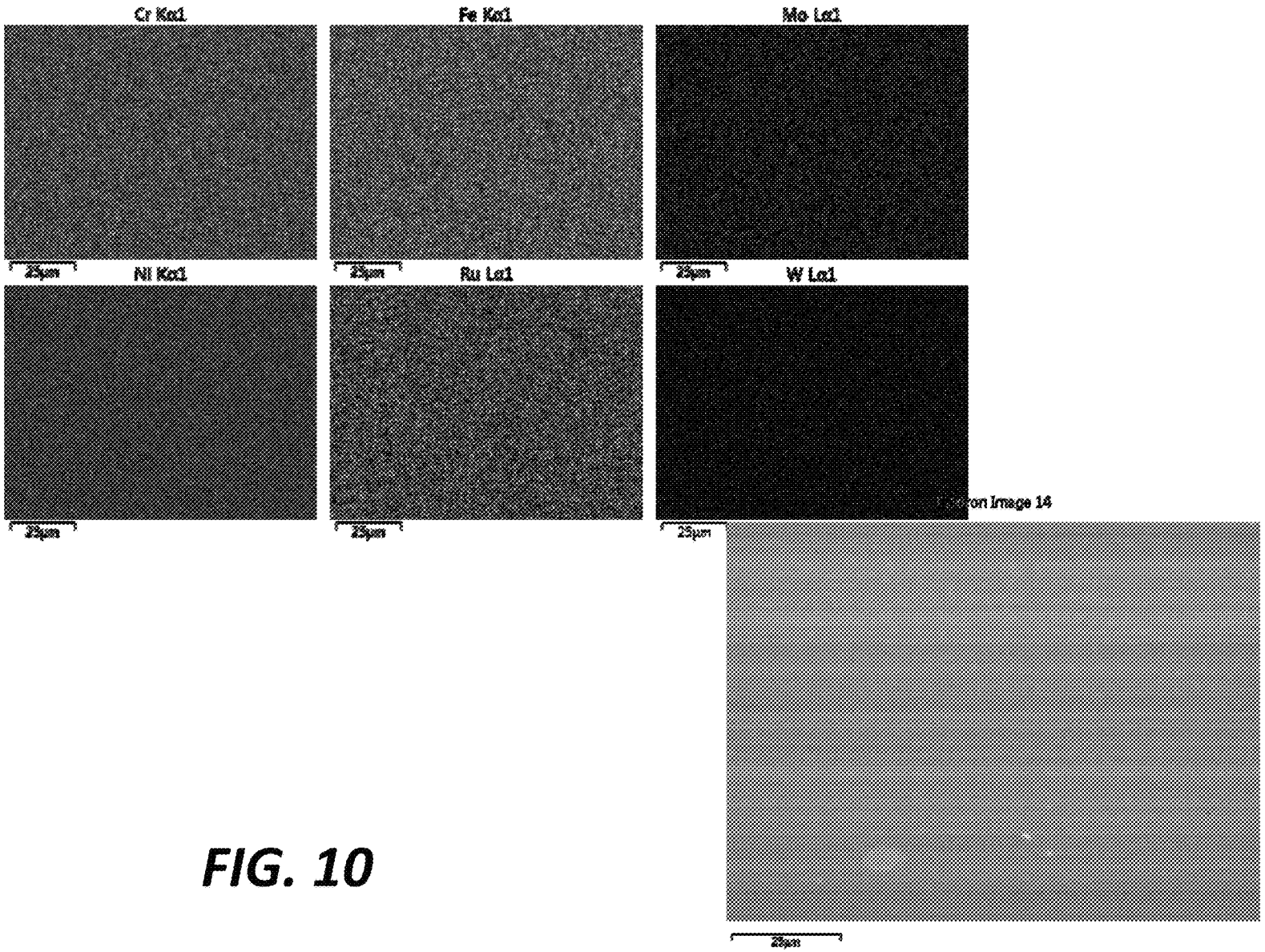
FIG. 10 shows SEM/EDS test results for another example embodiment of a CCA.

FIG. 10 shows SEM/EDS test results for Test Alloy 4 (no XRD test for Test Alloy 4 because the alloy oxidized during quench). EDS testing indicated the following atomic percentages (target in parentheses): 45.65 (44) at % Ni; 21.81 (21) at % Cr; 20.33 (20) at % Fe; 7.25 (7) at % Ru; 1.65 (2) at % W; and 3.31 (6) at % Mo.

Figure 11A:
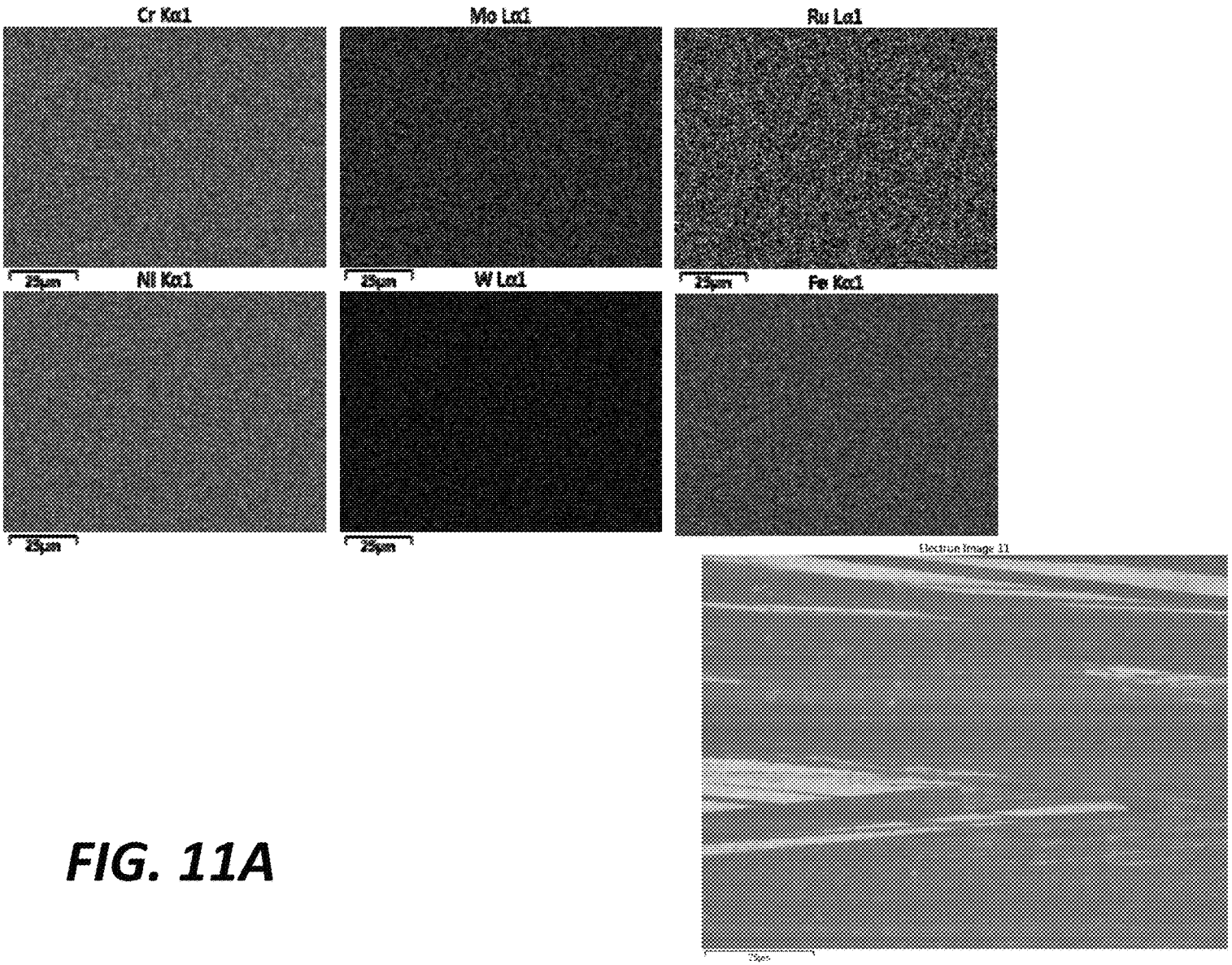
FIGS. 11A and 11B show SEM/EDS and XRD test results for another example embodiment of a CCA.
Figure 11B:
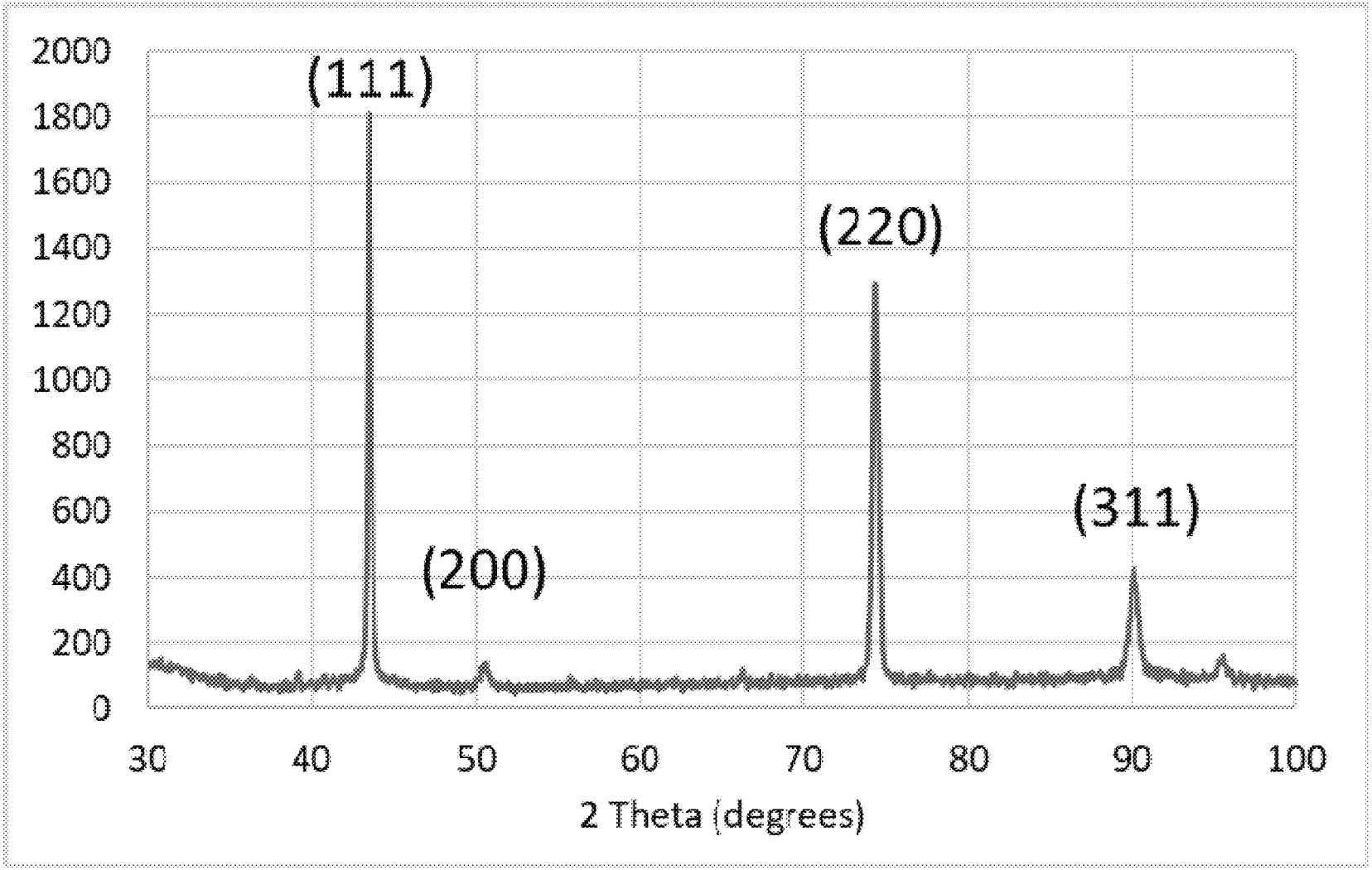

FIGS. 11A and 11B show SEM/EDS and XRD test results for Test Alloy 5. EDS testing indicated the following atomic percentages (target in parentheses): 48.64 (49) at % Ni; 21.93 (21) at % Cr; 20.41 (20) at % Fe; 2.14 (2) at % Ru; 1.71 (2) at % W; and 5.17 (6) at % Mo.

Figure 12A:
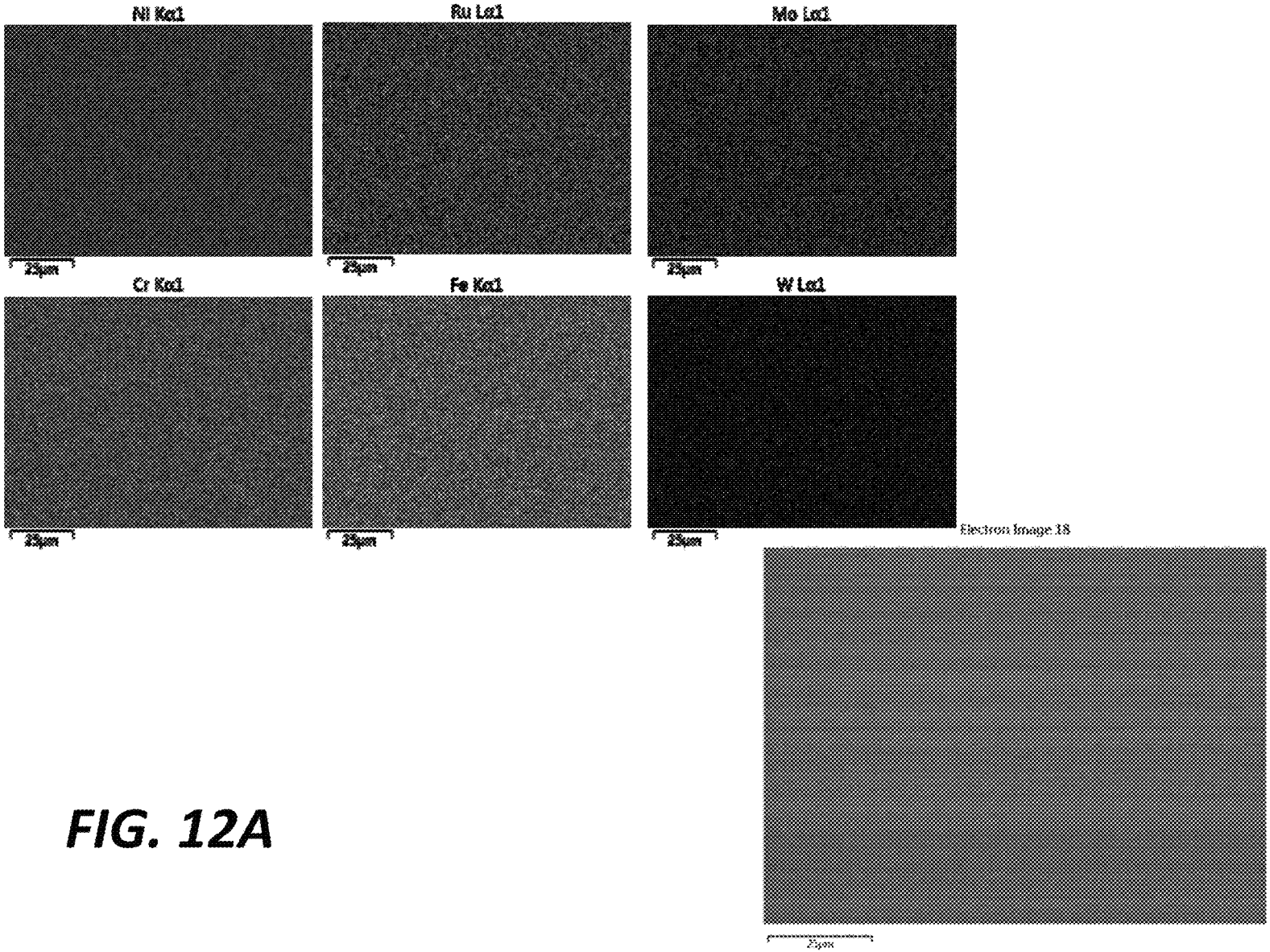
FIGS. 12A and 12B show SEM/EDS and XRD test results for another example embodiment of a CCA.
Figure 12B:
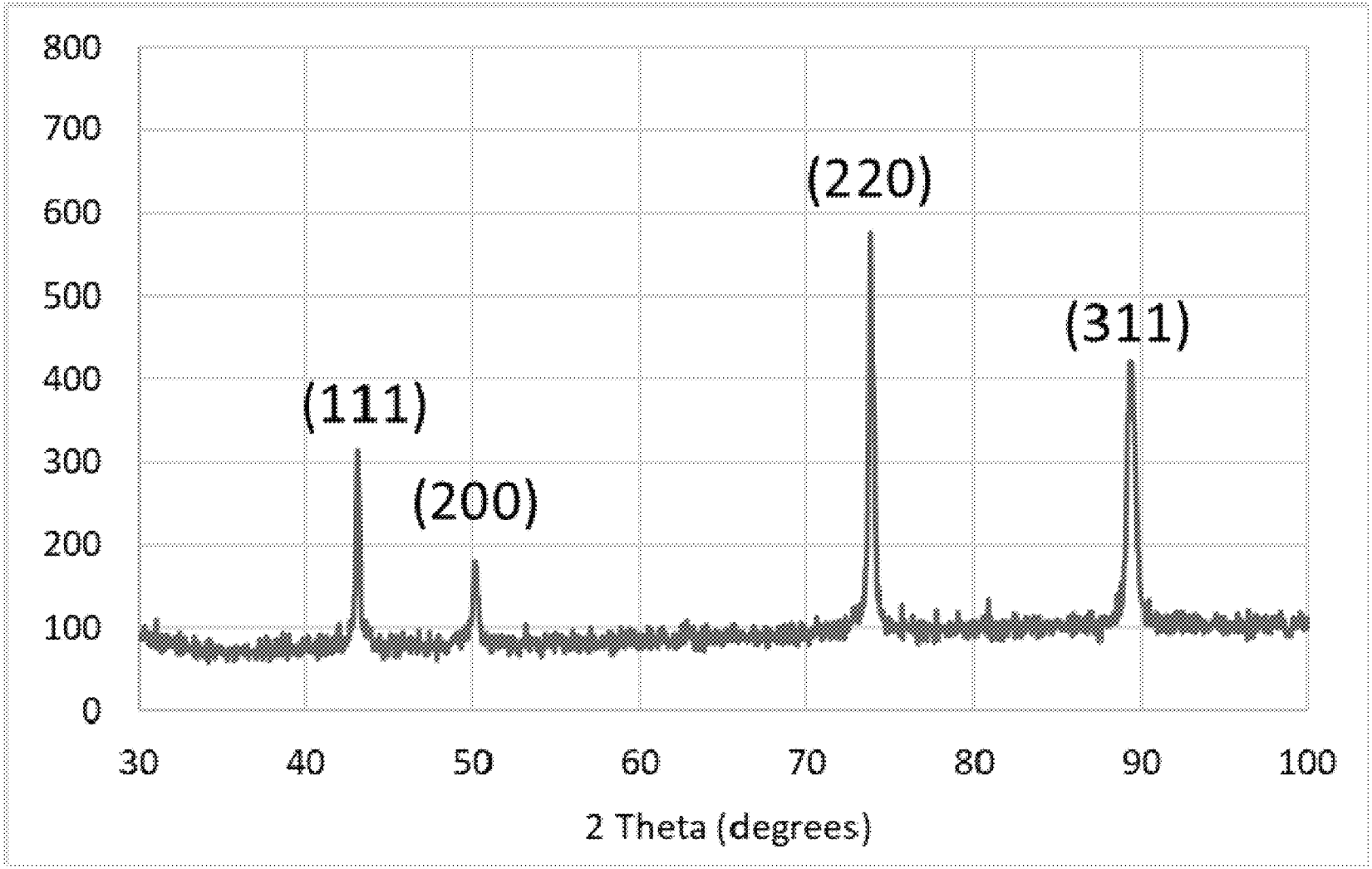

FIGS. 12A and 12B show EDS SEM/and XRD test results for Test Alloy 6. EDS testing indicated the following atomic percentages (target in parentheses): 37.19 (38) at % Ni; 21.71 (21) at % Cr; 25.37 (25) at % Fe; 8.29 (8) at % Ru; 1.89 (2) at % W; and 5.54 (6) at % Mo.

Figure 13A:
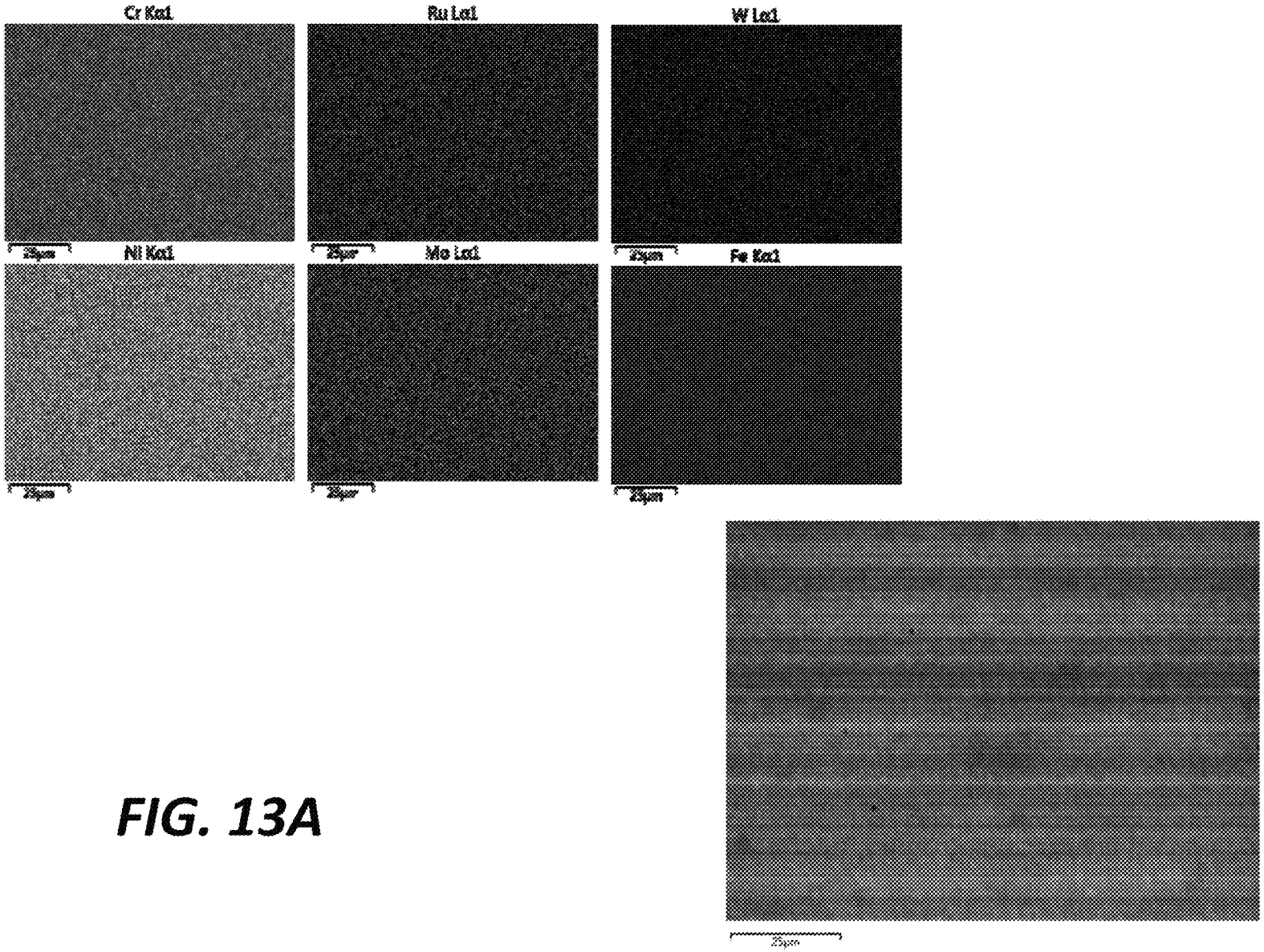
FIGS. 13A and 13B show SEM/EDS and XRD test results for another example embodiment of a CCA.
Figure 13B:
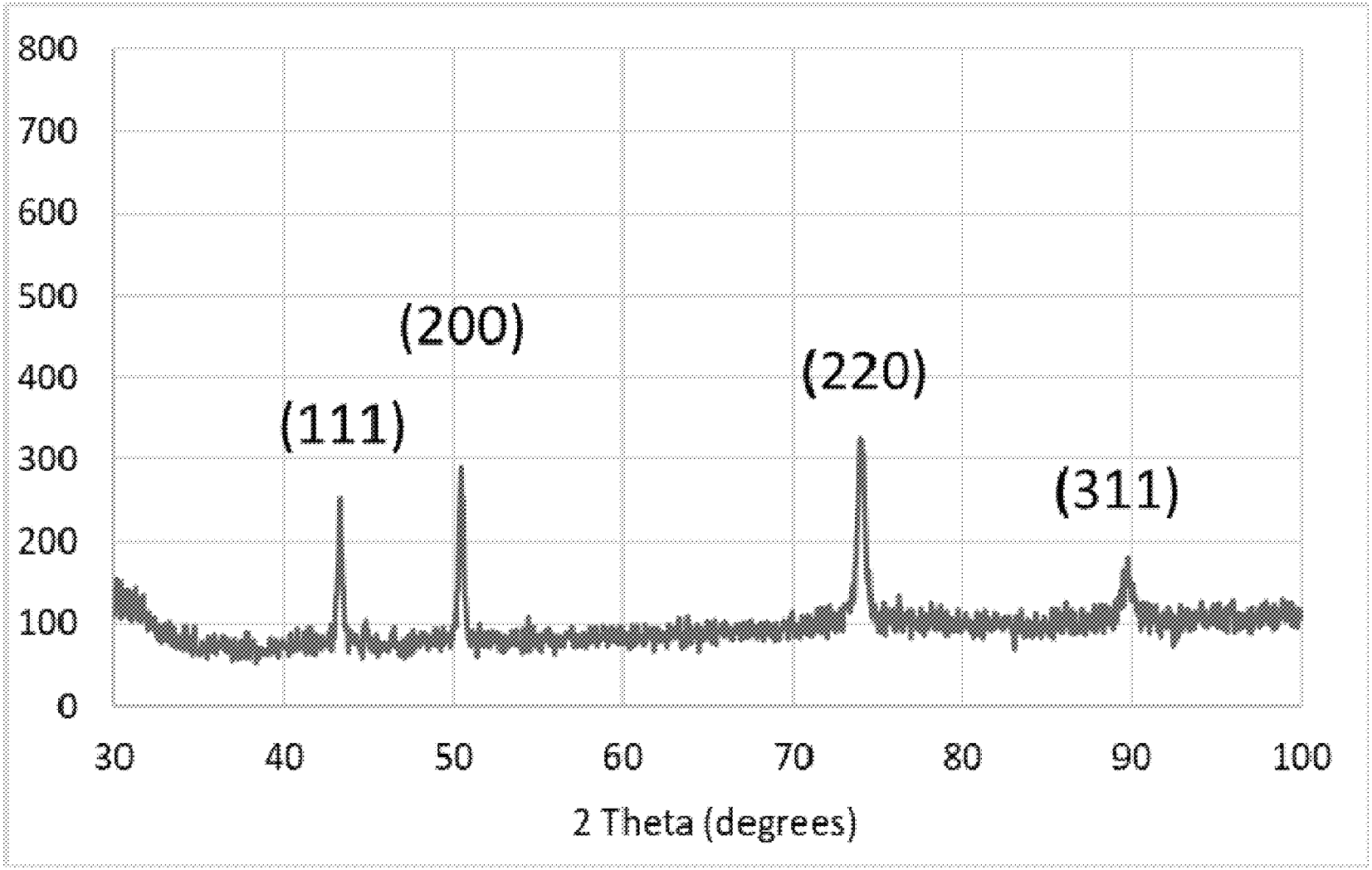

FIGS. 13A and 13B show SEM/EDS and XRD test results for Test Alloy 7. EDS testing indicated the following atomic percentages (target in parentheses): 37.50 (38) at % Ni; 21.69 (21) at % Cr; 30.24 (30) at % Fe; 2.96 (3) at % Ru; 1.95 (2) at % W; and 5.67 (6) at % Mo. The XRD results show high noise, which may be attributable to a very small sample.

Figure 14:
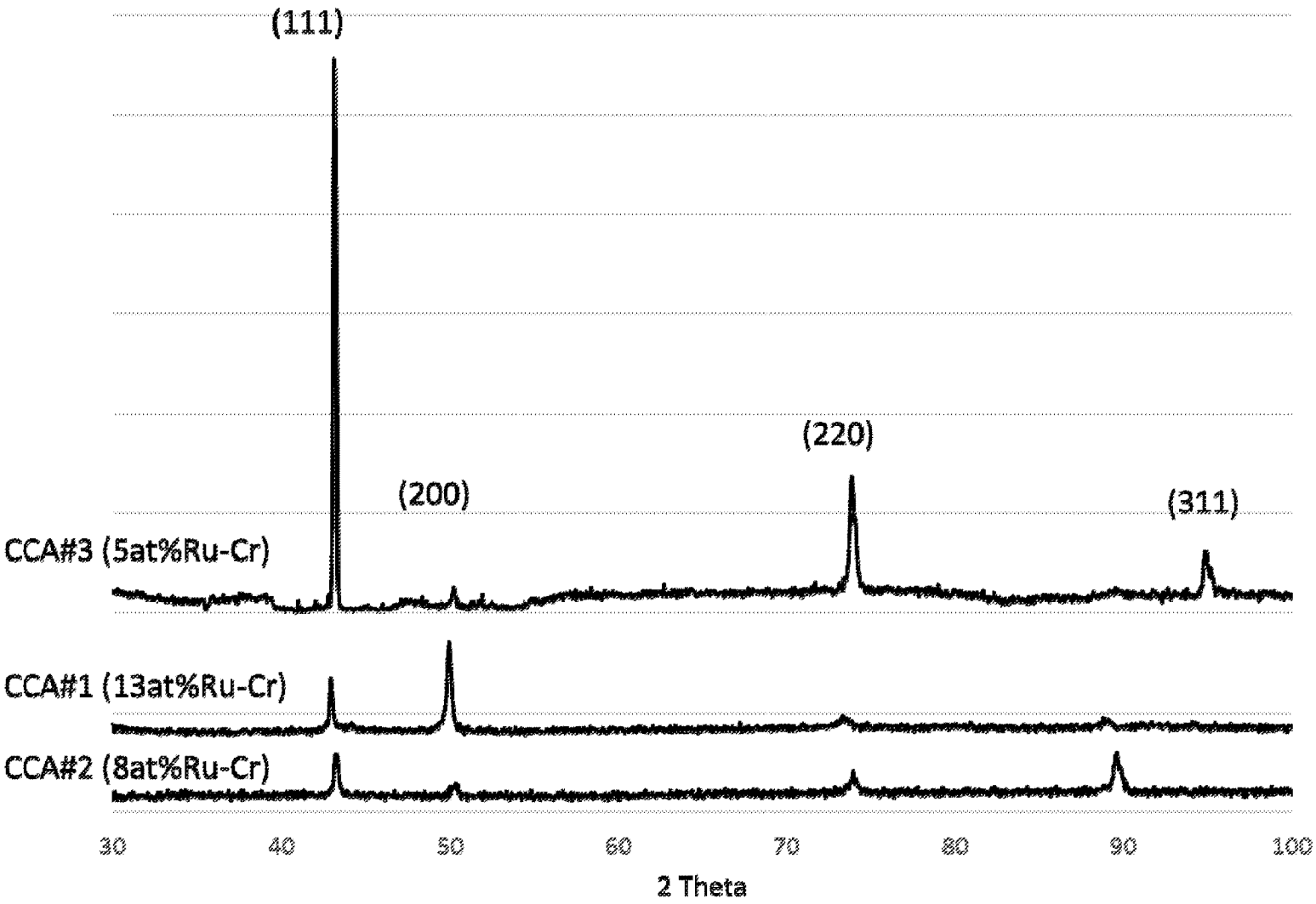
FIG. 14 shows XRD test results for the example embodiments of CCAs shown in FIGS. 7A-9B.
Figure 15:
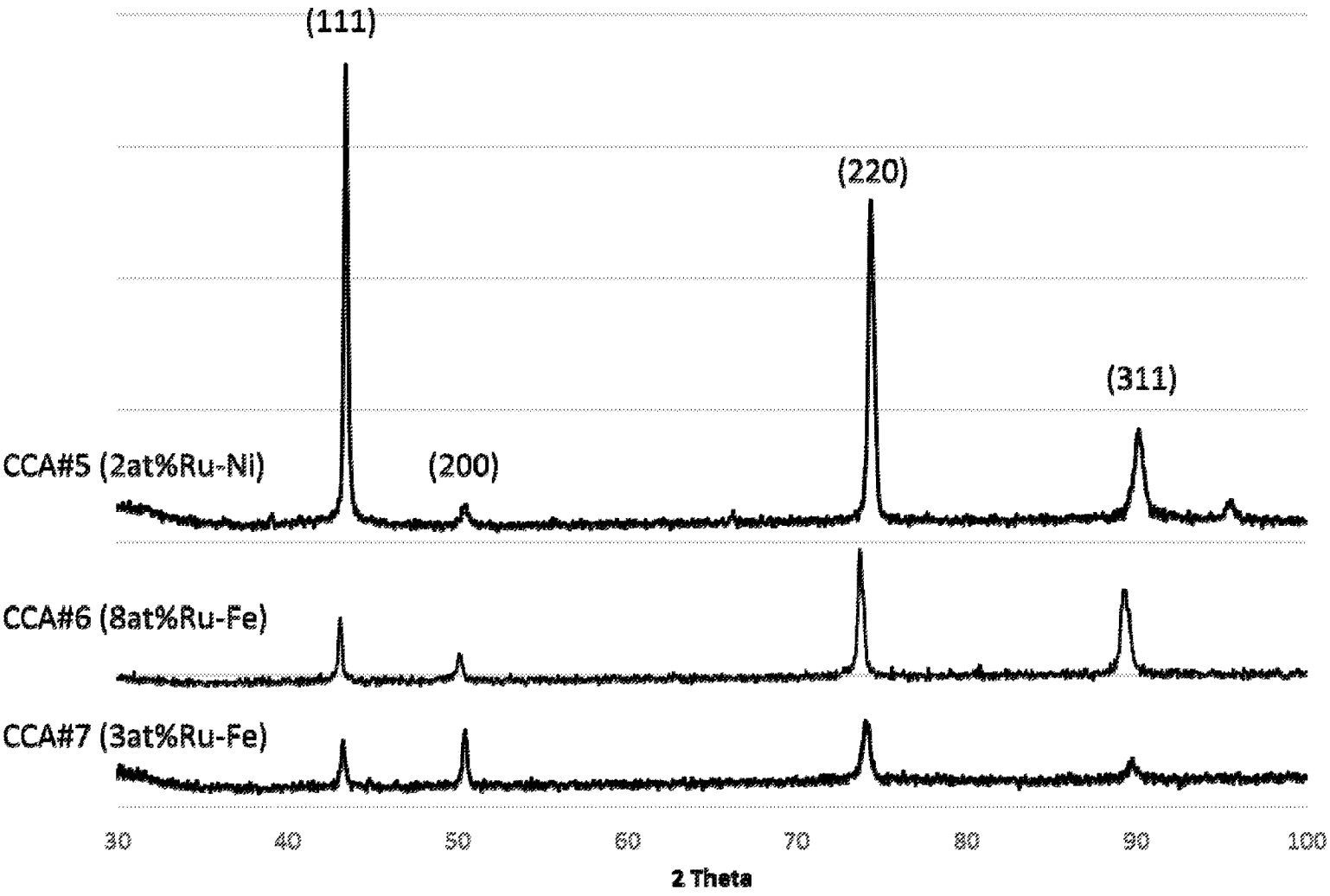
FIG. 15 shows XRD test results for the example embodiments of CCAs shown in FIGS. 10-13B.

FIG. 14 shows XRD results for Test Alloys 1-3. FIG. 15 shows XRD results for Test Alloys 5-7. The peaks in the samples' XRD spectra shown in FIGS. 14 and 15, such as (111), (200), (220), (311), are the characteristic peaks that only show up in FCC structure, and there are no other peaks existing in the spectra. The combination of observations from the EDS and XRD experimental tests confirm that the samples have a single FCC phase.

C. Experimental Corrosion Testing of Examples of Complex Concentrated Alloys

Experimental corrosion tests were performed on the alloys in Table 1, including a C-22 alloy sample. In particular, each alloy was tested by an electrochemical polarization method in a standard three-electrode cell to evaluate corrosion resistance. The testing solution was 1M NaCl+HCl (pH=1) at ambient temperature. A platinum mesh was used as the counter electrode and a saturated calomel electrode (SCE) was used as the reference electrode. The voltage was scanned from 200 mV below the open circuit potential up to 800 mV vs SCE at a scan rate of 0.5 mV/s.

Figure 16:
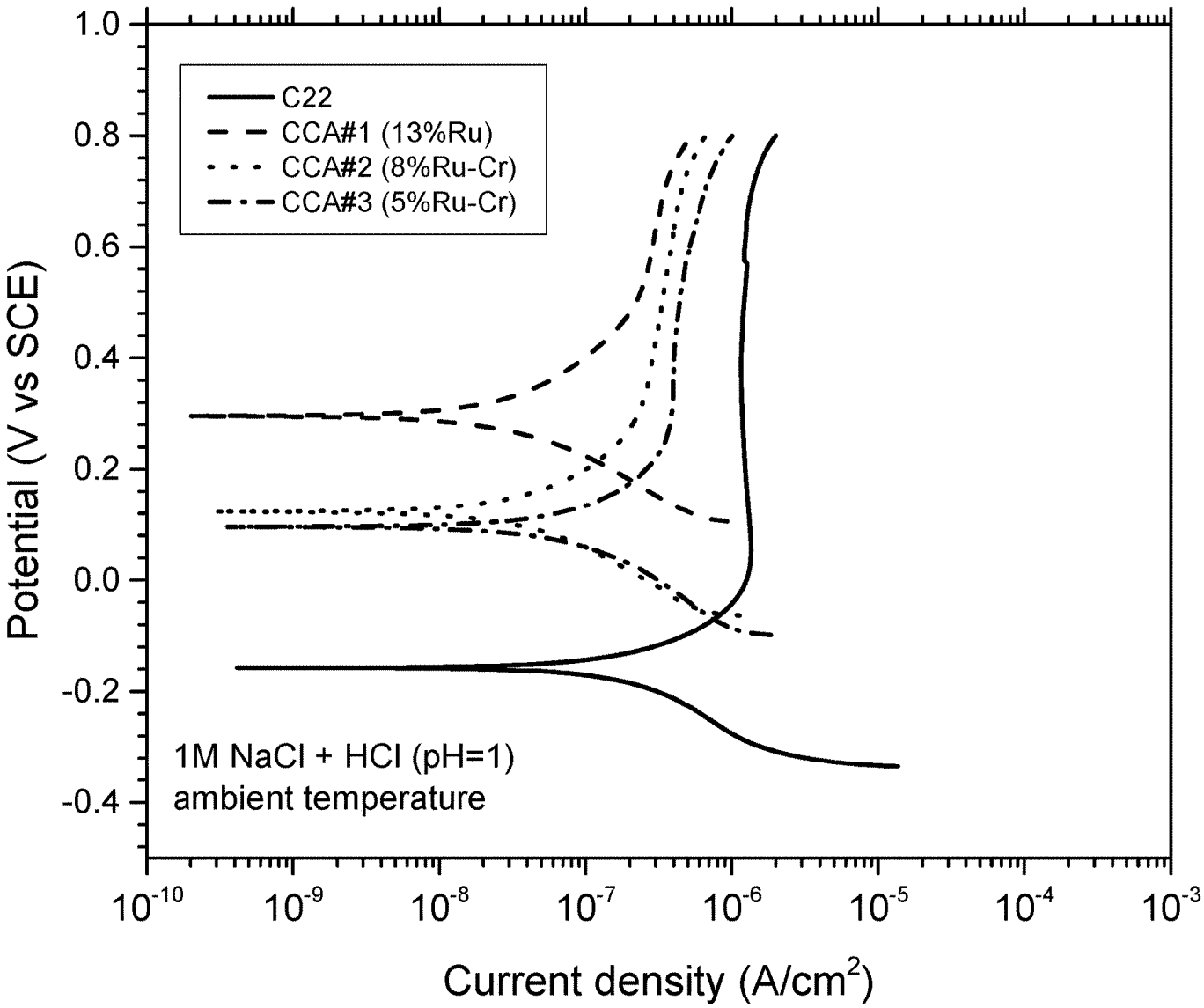
FIG. 16 shows polarization results for the example embodiments of CCAs shown in FIGS. 7A-9B and a commercial alloy.
Figure 17:
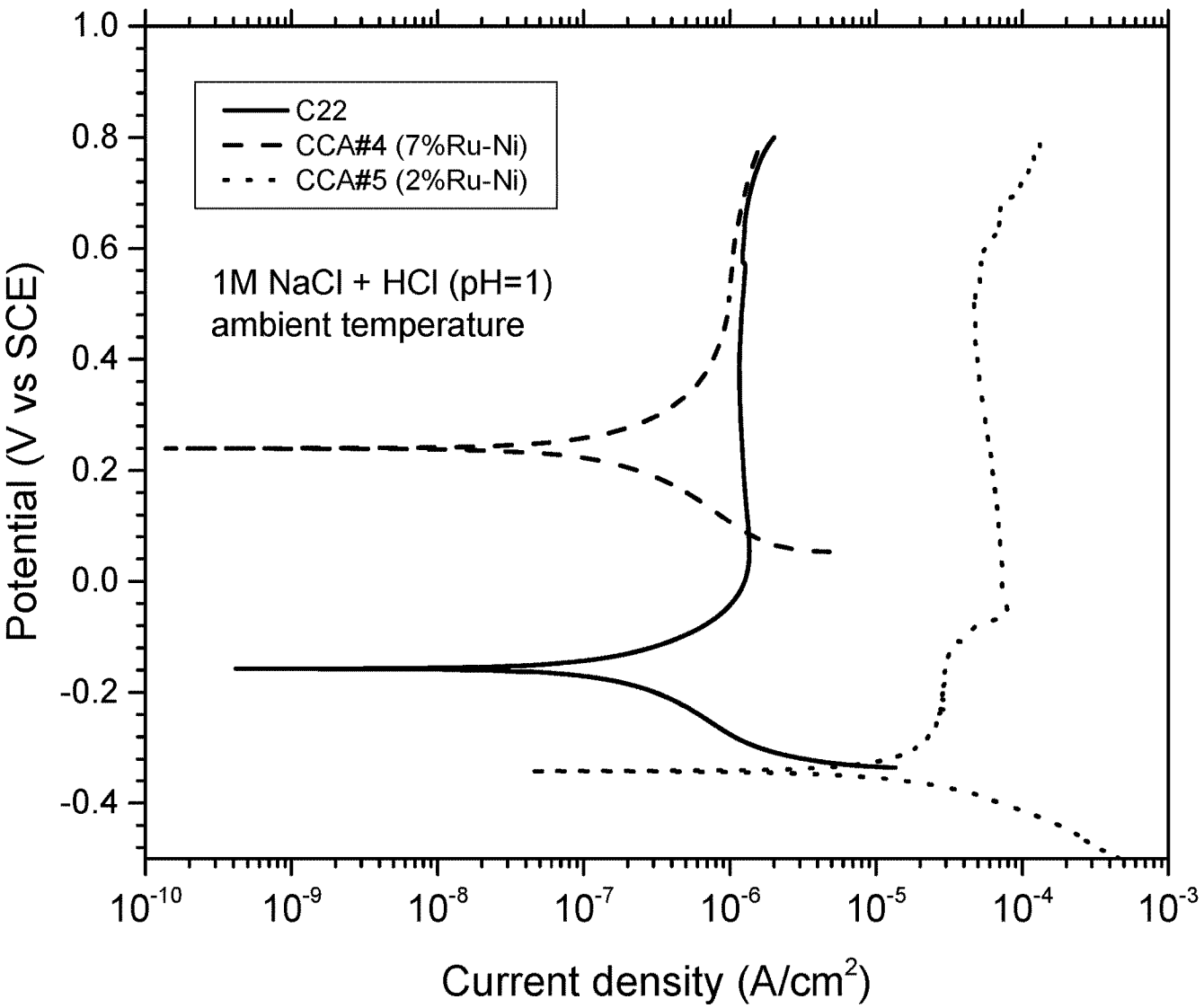
FIG. 17 shows polarization results for the example embodiments of CCAs shown in FIGS. 10-11B and the commercial alloy.
Figure 18:
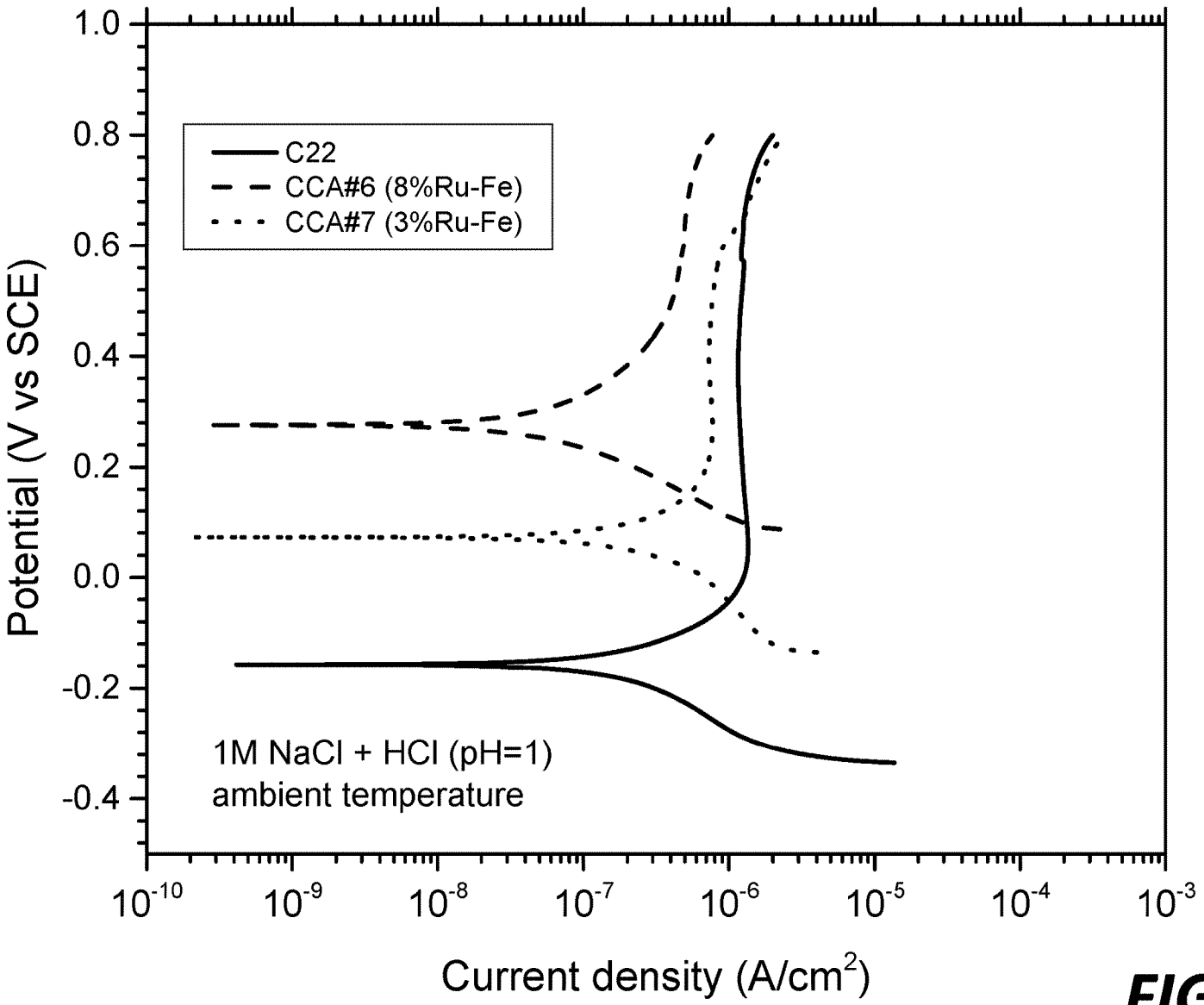
FIG. 18 shows polarization results for the example embodiments of CCAs shown in FIGS. 12A-13B and the commercial alloy.

FIGS. 16-18 show polarization results (potential vs. log [current density]). More specifically: FIG. 16 shows polarization results for Test Alloys 1-3 and C-22; FIG. 17 shows polarization results for Test Alloys 4 and 5 and C-22; and FIG. 18 shows polarization results for Test Alloys 6 and 7 and C-22.

All test alloy materials, as well as C-22, exhibited a passive region (the vertical linear section with a relatively constant current density), which is a manifestation of corrosion resistance. The current density of the passive region (passive current density) can be used as an indicator to quantify corrosion resistance, i.e., a lower passivity current density represents a lower corrosion rate and thereby better corrosion resistance.

Figure 19:
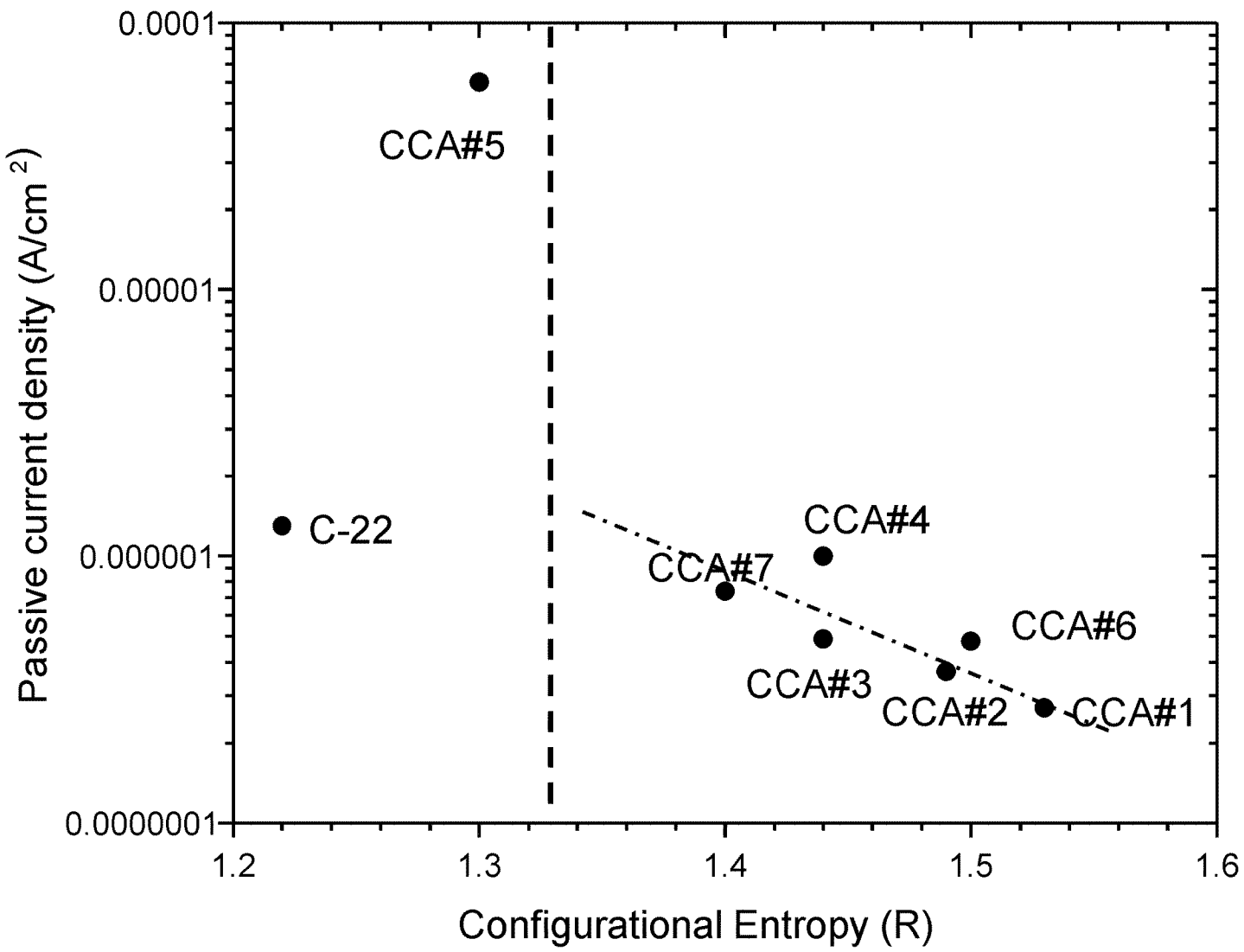
FIG. 19 shows the passivity current density for all test alloys plotted versus configurational entropy.
Figure 20:
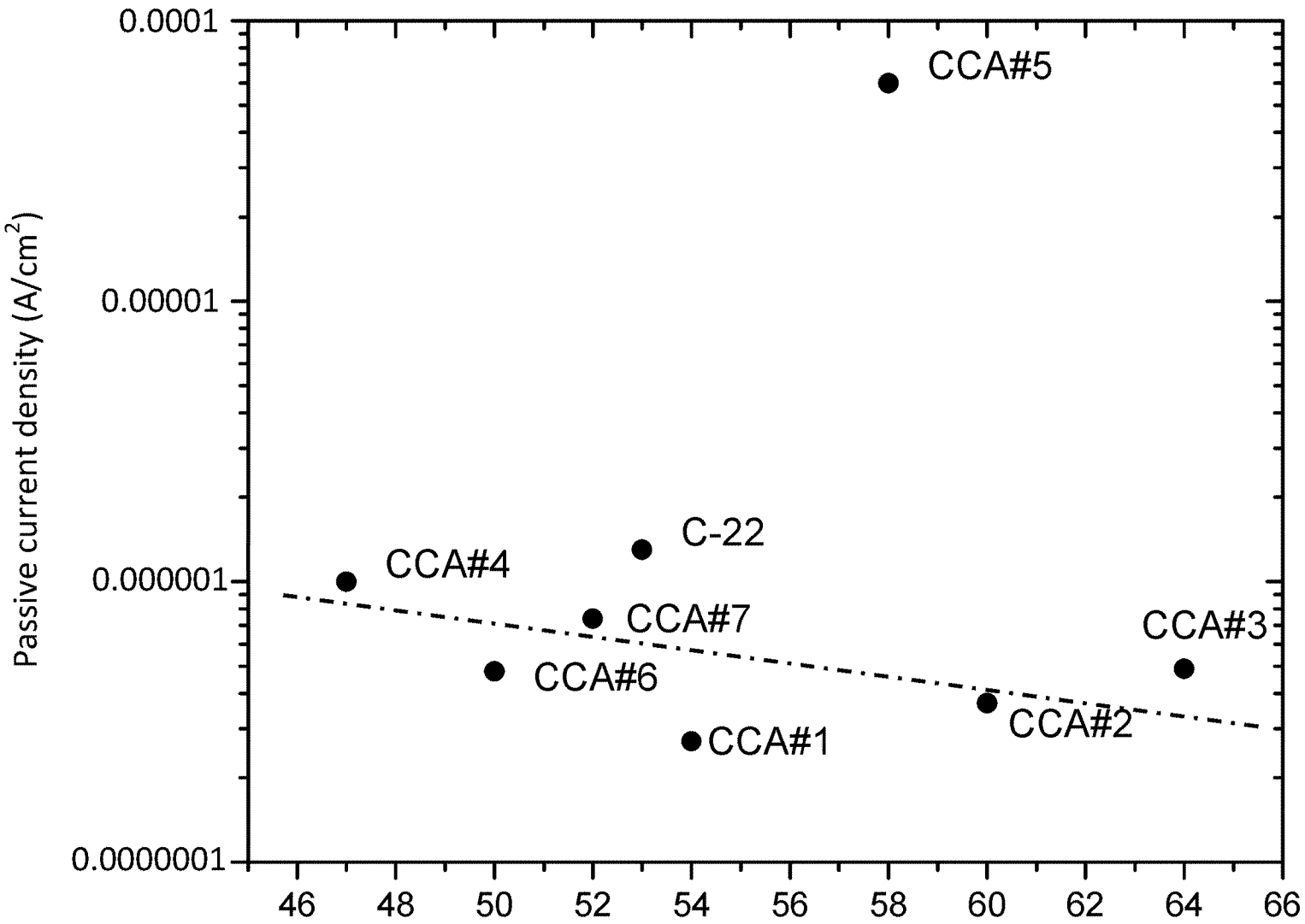
FIG. 20 shows the passivity current density for all alloys plotted versus pitting resistance equivalence number (PREN).
Figure 21:
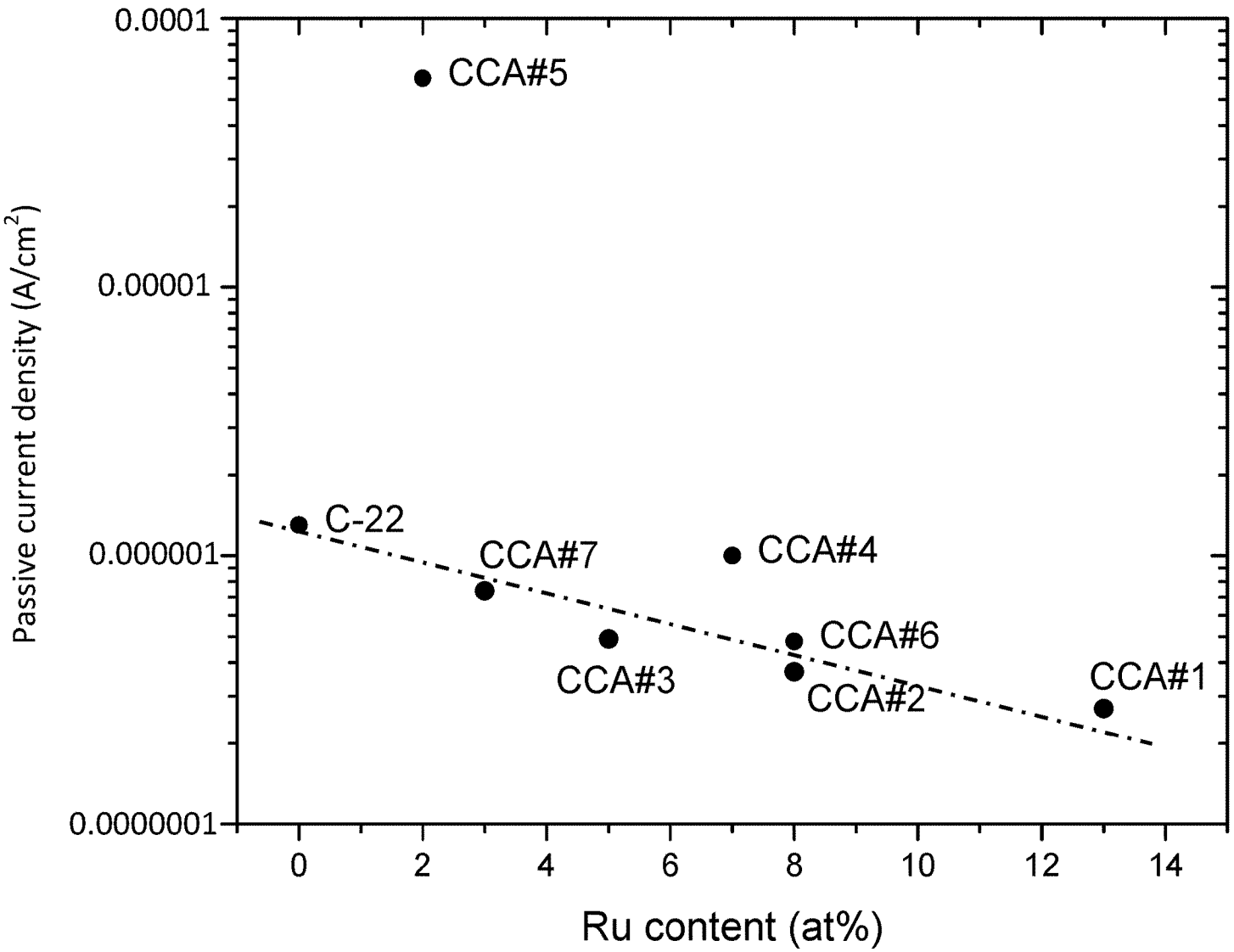
FIG. 21 shows the passivity current density for all alloys plotted versus Ru content.

FIG. 19 shows the passivity current density for all test alloys plotted versus configurational entropy ($\Delta S_{config}$). FIG. 20 shows the passivity current density for all alloys plotted versus pitting resistance equivalence number (PREN). FIG. 21 shows the passivity current density for all alloys plotted versus Ru content.

In FIG. 19, there appears to be a critical $\Delta S_{config}$ threshold somewhere between 1.3 R and 1.4 R, above which the passive current density drops dramatically by about two orders of magnitude. The passive current density further decreases as $\Delta S_{config}$ increases, indicating the positive impact of raising $\Delta S_{config}$ on promoting corrosion resistance.

In FIGS. 20 and 21, it appears that increasing PREN and Ru content are shown to generally decrease passivity current density and improve corrosion resistance. The exception is Test Alloy 5, which is an outlier that has a $\Delta S_{config}$ much lower than other compositions.

It is understood that the foregoing detailed description and accompanying examples are merely illustrative and are not to be taken as limitations upon the scope of the disclosure. Various changes and modifications to the disclosed embodiments will be apparent to those skilled in the art. Such changes and modifications, including without limitation those relating to the chemical structures, substituents, derivatives, intermediates, syntheses, compositions, formulations, or methods of use, may be made without departing from the spirit and scope of the disclosure.

What is claimed is:

1. A complex concentrated alloy comprising, by atomic percentage:
16% to 29% chromium;
20% iron;
2% to 18% ruthenium;
4% to 8% molybdenum;
1% to 3.5% tungsten; and
the balance of atomic percent comprising nickel and incidental elements and impurities.

2. The complex concentrated alloy according to claim 1, the pitting resistance equivalent number (PREN) being between 54 and 72.

3. The complex concentrated alloy according to claim 1, wherein the complex concentrated alloy has a single phase microstructure.

4. The complex concentrated alloy according to claim 1, comprising 2% to no more than 11.5% ruthenium.

5. The complex concentrated alloy according to claim 1, comprising no more than 49% nickel.

6. The complex concentrated alloy according to claim 3, the single phase microstructure being face centered cubic (FCC).

7. The complex concentrated alloy according to claim 6, wherein the complex concentrated alloy is homogenous.

8. The complex concentrated alloy according to claim 4, comprising 2% to no more than 7% ruthenium.

9. The complex concentrated alloy according to claim 5, comprising no less than 35% and no more than 49% nickel.

10. A method for producing a complex concentrated alloy, the method comprising:
preparing a melt that consists of, by atomic percentage,
19% to 29% chromium;
20% iron;
2% to 13% % ruthenium;
4% to 8% molybdenum;
1% to 3.5% tungsten; and
the balance of atomic percent comprising nickel and incidental elements and impurities.

11. The method according to claim 10, wherein the complex concentrated alloy has a pitting resistance equivalent number (PREN) of 54.

12. The method according to claim 10, wherein the complex concentrated alloy has a single phase face centered cubic microstructure.

13. The method according to claim 10, further comprising solutionizing the melt at 1250° C.

14. The method according to claim 10, comprising 38% to 49% nickel.

15. The method according to claim 12, wherein the complex concentrated alloy is homogenous.

16. A manufactured article comprising an alloy that comprises, by atomic percentage:
19% to 23% chromium;
20% iron;
11% to 15% ruthenium;
4% to 8% molybdenum;
1.5% to 3.5% tungsten; and
the balance of atomic percent comprising nickel and incidental elements and impurities,
wherein the alloy has a single phase microstructure.

17. The manufactured article according to claim 16, the complex concentrated alloy having a pitting resistance equivalent number (PREN) of 54; and
the a single phase microstructure being a face centered cubic microstructure.

18. The manufactured article according to claim 17, the complex concentrated alloy being homogenous.

* * * * *